US007968496B2

(12) United States Patent
Irita et al.

(10) Patent No.: US 7,968,496 B2
(45) Date of Patent: Jun. 28, 2011

(54) HEAT-SENSITIVE TRANSFER IMAGE-RECEIVING SHEET, IMAGE FORMING METHOD USING HEAT-SENSITIVE TRANSFER SYSTEM AND METHOD OF PRODUCING HEAT-SENSITIVE TRANSFER IMAGE RECEIVING SHEET

(75) Inventors: Kiyoshi Irita, Ashigarakami-gun (JP); Ryuji Shinohara, Minami-ashigara (JP); Takuya Arai, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 892 days.

(21) Appl. No.: 11/863,639

(22) Filed: Sep. 28, 2007

(65) Prior Publication Data

US 2008/0081134 A1 Apr. 3, 2008

(30) Foreign Application Priority Data

Sep. 29, 2006 (JP) ..... 2006-269369
Sep. 29, 2006 (JP) ..... 2006-269393

(51) Int. Cl.
*B41M 5/035* (2006.01)
*B41M 5/50* (2006.01)

(52) U.S. Cl. ..... 503/227; 427/152; 428/32.39

(58) Field of Classification Search ..... None
See application file for complete search history.

(56) References Cited

U.S. PATENT DOCUMENTS 5,356,853 A 10/1994 Ueno et al.
5,529,972 A * 6/1996 Ramello et al. ..... 503/227
5,834,151 A * 11/1998 Wada ..... 430/201
6,951,832 B2 * 10/2005 Kuroki et al. ..... 503/227
7,381,685 B2 * 6/2008 Oguma et al. ..... 503/227
7,485,402 B2 * 2/2009 Arai et al. ..... 430/201

FOREIGN PATENT DOCUMENTS

| | | | | |
|---|---|---|---|---|
| JP | 59-214696 | | | 12/1984 |
| JP | 62-105689 | | | 5/1987 |
| JP | 5-58062 | A | | 3/1993 |
| JP | 9-66674 | A | | 3/1997 |
| JP | 10-16395 | A | | 1/1998 |
| JP | 10-71775 | A | | 3/1998 |
| JP | 10-264542 | A | | 10/1998 |
| JP | 10-265542 | A | | 10/1998 |
| JP | 2872781 | | | 1/1999 |
| JP | 2000-238440 | | * | 9/2000 |
| JP | 2001-138641 | A | | 5/2001 |
| JP | 2002-19305 | A | | 1/2002 |
| JP | 2004-009572 | | * | 1/2004 |
| JP | 2006-88691 | A | | 4/2006 |

OTHER PUBLICATIONS

Japanese Office Action dated Feb. 8, 2011 for corresponding Japanese Patent Application No. JP 2006-269369.
Japanese Office Action dated Feb. 8, 2011 for corresponding Japanese Patent Application No. JP 2006-269393.

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet, containing, on a support, at least one receptor layer containing a matting agent, in which average particle diameter of the matting agent is in the range of from 50% to 200% of the thickness of the receptor layer, and the receptor layer contains a releasing agent; a producing method thereof; and an image-forming method using the heat-sensitive transfer image-receiving sheet.

32 Claims, No Drawings

HEAT-SENSITIVE TRANSFER IMAGE-RECEIVING SHEET, IMAGE FORMING METHOD USING HEAT-SENSITIVE TRANSFER SYSTEM AND METHOD OF PRODUCING HEAT-SENSITIVE TRANSFER IMAGE RECEIVING SHEET

FIELD OF THE INVENTION

The present invention relates to a heat-sensitive transfer image-receiving sheet, an image-forming method using heat-sensitive transfer system and a method of producing a heat-sensitive transfer image-receiving sheet.

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Soon Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities. In the dye diffusion transfer recording system, the heat-sensitive transfer image-receiving sheet directly contacts with the ink sheet as described above. Therefore, surface properties (including releasing property, friction, unevenness (roughness) and the like) of the heat-sensitive transfer image-receiving sheet are important.

With the spread of the dye diffusion transfer recording system, a speeding up of the print speed is progressing in recent years. Consequently, such a problem has arisen that even though thermal energy is applied to a usual heat-sensitive transfer image-receiving sheet for printing, it is difficult to obtain a sufficient developed color density. Further, with respect to a thermal transfer image of the printed material, there is a demand for the image with higher density and more vividness. Accordingly, attempts have been made to improve transfer sensitivity. One of them is the improved method of increasing thermal energy at the time of printing so that a more vivid transfer density can be obtained. However, this method causes serious thermal damage to the heat-sensitive transfer image-receiving sheet. Consequently, the following problems are becoming more and more conspicuous. (1) An ink ribbon dye layer is heat sealed together with a dye-receiving layer of the heat-sensitive transfer image-receiving sheet as a transferee material, and (2) not only dyes of the ink ribbon dye layer, but also the dye layer itself is transferred to the heat-sensitive transfer image-receiving sheet as a transferee material (that is, so-called abnormal transfer occurs). When the heat-sensitive transfer image-receiving sheet used for a high speed printer is designed, it is necessary to consider the surface properties, especially the releasing property, different from those properties required for the heat-sensitive transfer image-receiving sheet at the time of a low printing speed as in the past.

Besides, the ink sheet is transported along with the image-receiving sheet. Therefore, a force generated by a friction between the surface of the image-receiving sheet and the ink sheet tends to affect to the transport of the ink sheet. Accordingly unless a friction force is within a suitable range, a lag occurs in the transporting of the ink sheet and the image-receiving sheet. Such a lag sometimes results in transporting troubles such as various kinds of unevenness owing to, for example, shear in transfer and ink sheet wrinkles, and also cutting of the ink sheet during transporting.

From the past, attempts have been made to devise and improve the surface properties (for example, releasing property, friction and roughness) of the image-receiving sheet (see, for example, Japanese patent Nos. 2572769 and 2854319, JP-A-2005-238748 ("JP-A" means unexamined published Japanese patent application), JP-A-59-214696, JP-A-62-105689, Japanese patent No. 2872781, and JP-A-2005-70251).

In Japanese patent Nos. 2572769 and 2854319, and JP-A-2005-238748, there are descriptions that wax, such as polyethylene wax, amide wax, Teflon (registered trade mark), and urethane-modified wax, is added as a releasing agent to a receptor layer of the heat-sensitive transfer image-receiving sheet. These publications disclose that releasing property can be improved by addition of this kind of the releasing agent. However, there is no description of friction between the ink sheet and the image-receiving sheet, namely influence to transporting properties. Besides, there is no description that fine particles for controlling roughness are added to the heat-sensitive transfer image-receiving sheet.

In JP-A-59-214696 and JP-A-62-105689, there are descriptions that organic-series fillers, such as styrene resins and urea-formalin polycondensation resins, are contained in the heat-sensitive transfer image-receiving sheet. However, a purpose of addition of these fillers herein described is to enhance a density of the thermal transfer image. At that time, the above-described problems caused by speeding up of the printer had not yet become conspicuous. Consequently, in JP-A-59-214696 and JP-A-62-105689, there is no description about the influence of the releasing property or friction between the transfer material and the transferee material upon the transporting properties, and releasing function given by the organic fillers.

Japanese patent No. 2872781 discloses that inorganic fillers are used as a modifier of the surface properties. However, the surface properties herein described is modified in terms of writing properties, and there is no specific description that the function to give releasing property can be attained by addition of particular inorganic fillers.

On the other hand, it has been studied from the past in the field of a silver salt photographic art to add fine particles thereby to provide unevenness on the surface from the viewpoint of glossiness control. Fine particles having functions to provide such the unevenness on the surface have been referred to as a matting agent. Studies on control of the surface unevenness have been made using said matting agent from the viewpoint of, for example, adhesion or friction control of the surface in addition to the viewpoint of glossiness control. As specific examples, a stick of films on each other, a scratch, deformation of the matting agent at the time of heat development, and a peeling off are becoming problems, so that various studies on the matting agent have been made (for example, JP-A-2005-70251).

However, in such a silver halide photographic light-sensitive material, no image is formed by transfer of dyes. Therefore, it is not necessary to consider releasing property between the transfer sheet and the image-receiving sheet. Further, it is not necessary to consider transfer inhibition and transfer unevenness of the dyes when the dyes are transferred from the transfer sheet to the image-receiving sheet.

JP-A-2006-48024 proposes to use a matting agent in the transfer material such as a color filter. However, the matting agent herein described is for use in a back layer rather than a transfer layer.

SUMMARY OF THE INVENTION

The present invention resides in a heat-sensitive transfer image-receiving sheet, comprising, on a support, at least one receptor layer containing a matting agent, in which average particle diameter of the matting agent is in the range of from 50% to 200% of the thickness of the receptor layer, and the receptor layer contains a releasing agent; an image-forming method using the heat-sensitive transfer image-receiving sheet; and a producing method of the heat-sensitive transfer image-receiving sheet.

Further, the present invention resides in a heat-sensitive transfer image-receiving sheet comprising, on a support, at least one receptor layer containing a matting agent, in which said matting agent is fine particles having a particle diameter of from 1 to 10 μm and containing an organic compound; and a producing method thereof.

Other and further features and advantages of the invention will appear more fully from the following description.

DETAILED DESCRIPTION OF THE INVENTION

According to the present invention, there is provided the following means:

(1) A heat-sensitive transfer image-receiving sheet, comprising, on a support, at least one receptor layer containing a matting agent, wherein average particle diameter of the matting agent is in the range of from 50% to 200% of the thickness of the receptor layer, and wherein the receptor layer contains a releasing agent;

(2) The heat-sensitive transfer image-receiving sheet described in the above item (1), wherein said releasing agent is at least one compound selected from the group consisting of wax, a silicone-series compound and a fluorine-series surfactant;

(3) The heat-sensitive transfer image-receiving sheet described in the above item (1) or (2), further comprising at least one heat insulation layer containing at least one kind of hollow polymers;

(4) The heat-sensitive transfer image-receiving sheet described in any one of the above items (1) to (3), wherein said receptor layer contains a latex polymer containing a repeating unit derived from vinyl chloride;

(5) The heat-sensitive transfer image-receiving sheet described in any one of the above items (1) to (4), which is superposed in face to face on a heat-sensitive transfer sheet having at least two-color ink layers successively formed, wherein coefficient of static friction between a surface of the ink layer of the heat-sensitive transfer sheet to be transferred at the first time of image formation and an untransferred surface of the receptor layer of the heat-sensitive transfer image-receiving sheet, is 0.280 or more;

(6) The heat-sensitive transfer image-receiving sheet described in the above item (5), wherein coefficient of static friction between a surface of the ink layer of the heat-sensitive transfer sheet to be transferred at the second time of image formation and the surface of the receptor layer of the heat-sensitive transfer image-receiving sheet, to which the ink has transferred at the maximum density before this ink layer transfers, is 0.280 or more;

(7) The heat-sensitive transfer image-receiving sheet described in any one of the above items (1) to (6), wherein said receptor layer is formed by a method of using an aqueous coating solution;

(8) The heat-sensitive transfer image-receiving sheet described in the above item (7), wherein said receptor layer and said heat insulation layer are formed by a simultaneous multilayer coating;

(9) An image-forming method, which comprises superposing a heat-sensitive transfer sheet having at least two-color ink layers successively formed on a heat-sensitive transfer image-receiving sheet, wherein the heat-sensitive transfer image-receiving sheet comprises, on a support, at least one receptor layer containing a matting agent, wherein average particle diameter of the matting agent is in the range of from 50% to 200% of the thickness of the receptor layer, wherein the receptor layer contains a releasing agent, and wherein coefficient of static friction between a surface of the ink layer of the heat-sensitive transfer sheet to be transferred at the first time of image formation and an untransferred surface of the receptor layer of the heat-sensitive transfer image-receiving sheet, is 0.280 or more;

(10) The image-forming method described in the above item (9), wherein coefficient of static friction between a surface of the ink layer of the heat-sensitive transfer sheet to be transferred at the second time or later and the surface of the receptor layer of the heat-sensitive transfer image-receiving sheet, to which the ink has transferred at the maximum density before this ink layer transfers, is 0.280 or more;

(11) A method of producing the heat-sensitive transfer image-receiving sheet described in any one of the above items (1) to (6), which comprises forming the receptor layer by a method of using an aqueous coating solution;

(12) The method described in the above item (11), which comprises forming said receptor layer and said heat insulation layer by a simultaneous multilayer coating;

(13) A heat-sensitive transfer image-receiving sheet comprising, on a support, at least one receptor layer containing a matting agent, wherein said matting agent is fine particles having a particle diameter of from 1 to 10 μm and containing an organic compound;

(14) The heat-sensitive transfer image-receiving sheet described in the above item (13), wherein a glass transition temperature of the matting agent is 90° C. or more;

(15) The heat-sensitive transfer image-receiving sheet described in the above item (13), wherein a glass transition temperature of the matting agent is 130° C. or more;

(16) The heat-sensitive transfer image-receiving sheet described in the above item (13), wherein a decomposition temperature of the matting agent is 200° C. or more;

(17) The heat-sensitive transfer image-receiving sheet described in any one of the above items (13) to (16), wherein the matting agent comprises a melamine resin;

(18) The heat-sensitive transfer image-receiving sheet described in any one of the above items (13) to (17), further comprising, between the receptor layer and the support, at least one heat insulation layer containing hollow latex polymers and water-soluble polymers;

(19) The heat-sensitive transfer image-receiving sheet described in any one of the above items (13) to (18), wherein the receptor layer contains at least one kind of latex polymers;

(20) A method of producing the heat-sensitive transfer image-receiving sheet described in any one of the above items (13) to (19), which comprises coating the receptor layer and a layer adjacent to the receptor layer by a simultaneous multilayer coating; and

(21) The method described in the above item (20), wherein said adjacent layer is a heat insulation layer.

Hereinafter, a first embodiment of the present invention means to include the heat-sensitive transfer image-receiving sheet, as described in the items (1) to (8) above; the image-forming method, as described in the items (9) to (10) above; and the method of producing the heat-sensitive transfer image-receiving sheet, as described in the items (11) to (12) above.

Further, a second embodiment of the present invention means to include the heat-sensitive transfer image-receiving sheet, as described in the items (13) to (19) above; and the method of producing the heat-sensitive transfer image-receiving sheet, as described in the items (20) to (21) above.

Herein, the present invention means to include all of the above first and second embodiments, unless otherwise specified.

First, the heat-sensitive transfer image-receiving sheet of the present invention is explained.

The heat-sensitive transfer image-receiving sheet of the present invention (hereinafter also referred to as an image-receiving sheet) is provided with at least one dye-receiving layer (receptor layer) on a support. In particular, it is preferable that the heat-sensitive transfer image-receiving sheet of the present invention is further provided with at least one heat insulation layer. It is preferable to form the heat insulation layer between the receptor layer and the support. It is preferable to form an undercoat layer between the receptor layer and the support. As the undercoat layer, for example, a white background control layer, a charge control layer, an adhesive layer and a primer layer can be formed. Also, the heat insulation layer is preferably formed between the undercoat layer and the support. It is preferable that a curling control layer, a writing layer, or a charge-control layer be formed on the backside of the support. Each of these layers is applied using a usual method such as a roll coating, a bar coating, a gravure coating, a gravure reverse coating, a dye coating, a slide coating and a curtain coating. In practicing the present invention, a method capable of conducting a simultaneous multilayer coating, such as the slide coating and the curtain coating, is preferable.

(Receptor Layer)

The receptor layer performs functions of receiving dyes transferred from an ink sheet and retaining images formed. The image-receiving sheet of the present invention has at least one receptor layer preferably containing at least one thermoplastic receiving polymer that can receive the dyes.

In the present invention, particularly in the first embodiment of the present invention, the receptor layer may be formed by dissolving a receiving polymer and a compound having another function in a solvent and coating the resultant solution by a so-called solvent-coating method, followed by drying. Alternatively, the receptor layer may be formed by dispersing a receiving polymer as a latex polymer in a water-soluble dispersing medium, and further dissolving or dispersing a compound having another function in the medium, and then coating the resultant by a so-called water-based coating method (a method of using an aqueous coating solution), followed by drying.

Generally, the receptor layer formed by the solvent-coating method is preferably used from the view point that the receptor layer formed by this method exhibits a uniform thermal response because a coating of a homogeneous receiving polymer composition can be attained by the solvent-coating method.

In contrast, the receptor layer formed by the water-based coating method is preferably used because the receptor layer formed by this method enables such a functional design with a noticeable feature that a change of image sharpness owing to a lapse of time after transfer can be reduced using its heterogeneous receiving polymer composition, or alternatively mechanical properties of the receptor layer can be controlled using together with another latex having different properties from the receiving polymer. Further, the receptor layer formed by the water-based coating method is also preferably used from such a side view that an environmental load can be reduced because of solvent free, and also a low cost-making can be accomplished by a high speed coating and a multilayer coating.

In the present invention, particularly in the second embodiment of the present invention, the receiving polymer is preferably used, as it is dispersed in a water-soluble dispersion medium as a latex polymer. In addition, the receptor layer preferably contains a water-soluble polymer together with the latex polymer. Co-presence of the latex polymer and the water-soluble polymer allows presence of the water-soluble polymer, which is hardly dyable, among the latex polymers and prevents diffusion of the dye fixed on the latex polymer, and consequently, reduces changes in the color sharpness of the receptor layer with the lapse of time and forms a recorded image smaller in changes for its transferred image quality with the lapse of time.

The receptor layer may contain, in addition to the latex polymer of the receiving polymer, another latex polymer having a different function, for example, for the purpose of adjusting the elastic modulus of the film.

Besides, in the first embodiment of the present invention, the receptor layer also contains a releasing agent so as to control releasing property with the ink sheet. Further, the receptor layer for use in the present invention contains a matting agent.

In addition, the receptor layer may contain various functional materials such as a surfactant, a thickener and a setting agent each of which is used for improvement of coating properties, and an electrostatic moderator.

In the present invention, particularly in the first embodiment of the present invention, a thickness of the receptor layer is not limited in particular. However, the thickness is preferably from 2 to 10 μm, and more preferably from 2.5 to 8 μm.

<Receiving Polymer>

The thermoplastic polymer (latex polymer) that can be used as the receiving polymer is not limited in particular, in so far as the polymer enables to receive dyes transferred from a transfer material. However, hydrophobic polymers such as vinyl chlorides, acrylates, polyesters (including ones having a polycarbonate structure), rubbers (e.g., SBR resins), polyurethanes, polyvinyl chlorides, polyvinyl acetates, polyvinylidene chlorides, and polyolefins, are preferably used.

In the present invention, particularly in the first embodiment of the present invention, among these, vinyl chlorides, polyesters (including ones having a polycarbonate structure), acrylates, rubbers (e.g., SBR resins), and polyvinyl acetates are more preferable; and vinyl chlorides are furthermore preferable.

In the present invention, particularly in the second embodiment of the present invention, among these, vinyl chlorides, acrylates, rubbers (e.g., SBR resins), and polyvinyl acetates are more preferable; and vinyl chlorides are furthermore preferable.

The receiving polymer may be used in the form of a solvent-coating-type polymer that is dissolved in a solvent before use, or a latex polymer that is dispersed in a water-soluble medium before use. Namely, the form of the receiving polymer is not limited in particular.

The following is an explanation of the latex polymer type receiving polymer preferably used for the water-based coating that is one of preferable embodiments of the present invention. As the solvent-coating type receiving polymer, there can be used polymers having properties similar to the properties described below.

<Latex Polymer>

The latex polymer that can be used in the present invention is explained.

In the heat-sensitive transfer image-receiving sheet of the present invention, the latex polymer that can be used in the receptor layer is a dispersion in which water-insoluble hydrophobic polymers are dispersed as fine particles in a water-soluble dispersion medium. As the latex polymer, there is no particular limitation, in so far as the latex polymer uses at least one thermoplastic polymer capable of receiving dyes transferred from a transfer material. One kind of latex polymer having a particular structure may be used singly. Alternatively, multiple kinds of different latex polymers may be used in combination.

The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth.

In the present invention, particularly in the first embodiment of the present invention, the average diameter of the dispersed particles is preferably in the range of approximately 1 to 50,000 nm, more preferably 5 to 1,000 nm.

In the present invention, particularly in the first embodiment of the present invention, the particle diameter distribution of the dispersed particles is not particularly limited, and thus, the particles may have a wide particle diameter distribution or a monodispersion-like particle diameter distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer that can be used in the present invention is preferably −30° C. to 100° C., more preferably 0° C. to 80° C., further more preferably 10° C. to 70° C., and especially preferably 15° C. to 60° C.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

In the present invention, as the latex polymer that can be used in the receptor layer, a latex polymer containing a repeating unit derived from vinyl chloride (vinyl chloride-based latex) is one of preferable embodiments. In the present invention, particularly in the first embodiment of the present invention, as the vinyl chloride-based latex, there can be preferably used polyvinyl chlorides, a copolymer comprising vinyl chloride unit, such as a vinyl chloride-vinyl acetate copolymer and a vinyl chloride acrylate copolymer. In case of the copolymer, the vinyl chloride unit in molar ratio is preferably in the range of from 50% to 95%.

These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight. Polymers having excessively small molecular weight impart insufficient dynamic strength to the layer containing the latex, and polymers having excessively large molecular weight bring about poor filming ability, and therefore both cases are not preferable. Crosslinkable latex polymers are also preferably used.

The vinyl chloride-based latex that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

In the present invention, particularly in the first embodiment of the present invention, in addition to the vinyl chloride-based latex, hydrophobic polymers such as acrylic-series polymers, polyesters, rubbers (e.g., SBR resins), polyurethanes, polyvinyl chlorides, polyvinyl acetates, polyvinylidene chlorides, and polyolefins, are preferably used. In the present invention, particularly in the first embodiment of the present invention, another latex polymer that can be used with the latex polymer containing a repeating unit derived from vinyl chloride (vinyl chloride-based latex) in combination, is not particularly limited, but hydrophobic polymers such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight. A polymer having an excessively small molecular weight imparts insufficient dynamic strength to a layer containing a latex of the polymer, and a polymer having an excessively large molecular weight brings about poor filming ability, and therefore both cases are undesirable. Crosslinkable polymer latexes are also preferably used.

In synthesis of the latex polymer used in the present invention, there is no particular limitation to monomers to be used in combination, and the following monomer groups (a) to (j) may be preferably used as those polymerizable in a usual radical polymerization or ion polymerization method. These monomers may be selected singly or combined freely to synthesize the latex polymer.

-Monomer Groups (a) to (j)-

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethylhexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multifunctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

The latex polymer having the other structure that can be used in combination with the latex polymer having repeating units derived from vinyl chloride (vinyl chloride-based latex) is also commercially available, and polymers described below may be utilized in combination.

Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857x2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K.K.); and Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); and Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of the polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); and Zaikusen and Ceporjon G (trade names, manufactured by Sumitomo Seika Chemicals Co., Ltd.).

Examples of the copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended, if necessary.

In the receptor layer for use in the present invention, a ratio of the latex polymer comprising a component of vinyl chloride is preferably 50 mass % or more, more preferably 70 mass % or more, of the whole solid content in the layer.

The glass transition temperature (Tg) of the latex polymer that can be used in the present invention, particularly in the first embodiment of the present invention, is preferably in the range of −30° C. to 70° C., more preferably −10° C. to 50° C., still more preferably 0° C. to 40° C., in view of film-forming properties (brittleness for working) and image preservability. In the present invention, particularly in the second embodiment of the present invention, the glass transition temperature (Tg) of the latex polymer having the other structure that can be used in combination with the latex polymer comprising vinyl chloride as a monomer unit is preferably in the range of −30° C. to 100° C., more preferably 0° C. to 80° C., still more preferably 20° C. to 70° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The latex polymer preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of a latex polymer. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the present invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

The latex polymer that can be used in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer that can be used in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides such as ammonium persulfate, sodium persulfate, and potassium persulfate are especially preferable from the viewpoints of image preservability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image preservability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H (trade name) manufactured by Kao Corporation,) are still more preferable, and low electrolyte types such as PIONIN A-43-S (trade name, manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer that can be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N'''-hexaacetic acid, and 1,2,3-triaminopropane-N,N,N',N'',N''',N'''-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties deteriorate.

In the preparation of the latex polymer that can be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the present invention, it is preferable to prepare the latex polymer by applying an aqueous type coating solution and then drying it. The "aqueous type" so-called here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The latex polymer in the image-receiving sheet used in the present invention includes a state of a gel or dried film formed by removing a part of solvents by drying after coating.

<Water-Soluble Polymer>

The receptor layer preferably contains a water-soluble polymer. Herein, the water-soluble polymer is described below.

Herein, "water-soluble polymer" means a polymer which dissolves, in 100 g water at 20° C., in an amount of preferably 0.05 g or more, more preferably 0.1 g or more, further preferably 0.5 g or more, and particularly preferably 1 g or more.

When the receptor layer is formed by a method of using an aqueous coating solution, the receptor layer preferably contains a water-soluble polymer. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention.

In the present invention, the water-soluble polymer is also referred to as a binder, for differentiation from the latex polymer described above.

Among the water-soluble polymers which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Gelatin is one of preferable embodiments in the present invention. Gelatin having a molecular weight of from 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal atom) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Among the water-soluble synthetic polymers that can be used in the present invention, polyvinyl alcohols are preferable. The polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; and L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid added is preferably 0.01 to 40 mass % with respect to polyvinyl alcohol.

Preferred binders are transparent or semitransparent, and generally colorless. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides. These media are water-soluble.

In the present invention, preferred water-soluble polymers are polyvinyl alcohols and gelatin, with gelatin being most preferred.

The amount of the water-soluble polymer added to the receptor layer is preferably from 1 to 25% by mass, more preferably from 1 to 10% by mass based on the entire mass of the receptor layer.

<Hardener>

In the present invention, the image-receiving sheet preferably contains a crosslinking agent.

As the crosslinking agent that can be used in the present invention, a hardener (hardening agent) may be added in coating layers (e.g., the receptor layer, the heat insulation layer, the undercoat layer) of the image-receiving sheet.

Preferable examples of the hardener that can be used in the present invention include H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in Claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be mentioned.

Preferable examples of the hardener include a vinylsulfone-series hardener and chlorotriazines.

More preferable hardeners in the present invention are compounds represented by the following Formula (B) or (C).

$$(CH_2{=}CH{-}SO_2)_n\text{-}L \qquad \text{Formula (B)}$$

$$(X{-}CH_2{-}CH_2{-}SO_2)_n\text{-}L \qquad \text{Formula (C)}$$

In formulae (B) and (C), X represents a halogen atom, L represents an organic linking group having n-valency. When the compound represented by formula (B) or (C) is a low-molecular compound, n denotes an integer from 1 to 4. When the compound represented by formula (B) or (C) is a high-molecular (polymer) compound, L represents an organic linking group containing a polymer chain and n denotes an integer ranging from 10 to 1,000.

In the Formulae (B) and (C), X is preferably a chlorine atom or a bromine atom, and further preferably a bromine atom. n is an integer from 1 to 4, preferably an integer from 2 to 4, more preferably 2 or 3 and most preferably 2.

L represents an organic group having n-valency, and preferably an aliphatic hydrocarbon group, an aromatic hydrocarbon group or a heterocyclic group, provided that these groups may be combined through an ether bond, ester bond, amide bond, sulfonamide bond, urea bond, urethane bond or the like. Also, each of these groups may be further substituted. Examples of the substituent include a halogen atom, alkyl group, aryl group, heterocyclic group, hydroxyl group, alkoxy group, aryloxy group, alkylthio group, arylthio group, acyloxy group, alkoxycarbonyl group, carbamoyloxy group, acyl group, acyloxy group, acylamino group, sulfonamide group, carbamoyl group, sulfamoyl group, sulfonyl group, phosphoryl group, carboxyl group and sulfo group. Among these groups, a halogen atom, alkyl group, hydroxy group, alkoxy group, aryloxy group and acyloxy group are preferable.

Specific examples of the vinylsulfone-series hardener include, though not limited to, the following compounds (VS-1) to (VS-27).

$$CH_2{=}CH{-}SO_2{-}CH_2{-}SO_2{-}CH{=}CH_2 \qquad \text{(VS-1)}$$

$$CH_2{=}CH{-}SO_2{-}CH_2CH_2{-}SO_2{-}CH{=}CH_2 \qquad \text{(VS-2)}$$

$$CH_2{=}CH{-}SO_2{-}CH_2CH_2CH_2{-}SO_2{-}CH{=}CH_2 \qquad \text{(VS-3)}$$

-continued $$CH_2{=}CH{-}SO_2{-}CH_2\overset{\overset{CH_3}{|}}{C}HCH_2{-}SO_2{-}CH{=}CH_2 \qquad \text{(VS-4)}$$

$$CH_2{=}CH{-}SO_2{-}CH_2OCH_2{-}SO_2{-}CH{=}CH_2 \qquad \text{(VS-5)}$$

$$CH_2{=}CH{-}SO_2{-}CH_2CH_2OCH_2CH_2{-}SO_2{-}CH{=}CH_2 \qquad \text{(VS-6)}$$

$$CH_2{=}CH{-}SO_2{-}CH_2\underset{\underset{O}{\|}}{C}NHCH_2CH_2NH\underset{\underset{O}{\|}}{C}CH_2{-}SO_2{-}CH{=}CH_2 \qquad \text{(VS-7)}$$

$$CH_2{=}CH{-}SO_2{-}CH_2\underset{\underset{O}{\|}}{C}NHCH_2CH_2CH_2NH\underset{\underset{O}{\|}}{C}CH_2{-}SO_2{-}CH{=}CH_2 \qquad \text{(VS-8)}$$

$$CH_2{=}CH{-}SO_2{-}CH_2\overset{\overset{OH}{|}}{C}HCH_2{-}SO_2{-}CH{=}CH_2 \qquad \text{(VS-9)}$$

$$CH_2{=}CH{-}SO_2{-}CH_2\overset{\overset{OH}{|}}{C}HCH\underset{\underset{OH}{|}}{C}H_2{-}SO_2{-}CH{=}CH_2 \qquad \text{(VS-10)}$$

$$CH_2{=}CH{-}SO_2{-}CH_2\overset{\overset{OH}{|}}{C}HCH\overset{\overset{OH}{|}}{C}H_2{-}SO_2{-}CH{=}CH_2 \qquad \text{(VS-11)}$$

$$CH_2{=}CH{-}SO_2{-}CH_2\overset{\overset{OH}{|}}{C}HCH_2\overset{\overset{OH}{|}}{C}HCH_2{-}SO_2{-}CH{=}CH_2 \qquad \text{(VS-12)}$$

$$CH_2{=}CH{-}SO_2{-}CH_2\overset{\overset{OH}{|}}{C}HCH_2CH_2\overset{\overset{OH}{|}}{C}HCH_2{-}SO_2{-}CH{=}CH_2 \qquad \text{(VS-13)}$$

$$CH_2{=}CH{-}SO_2{-}CH_2\overset{\overset{OH}{|}}{C}HCH_2\overset{\overset{CH_3}{|}}{C}HCH_2\overset{\overset{OH}{|}}{C}HCH_2{-}SO_2{-}CH{=}CH_2 \qquad \text{(VS-14)}$$

$$CH_2{=}CH{-}SO_2{-}CH_2\overset{\overset{OH}{|}}{C}HCH_2OCH_2\overset{\overset{OH}{|}}{C}HCH_2{-}SO_2{-}CH{=}CH_2 \qquad \text{(VS-15)}$$

$$CH_2{=}CH{-}SO_2{-}CH_2\overset{\overset{OH}{|}}{C}HCH_2\overset{\overset{O}{\|}}{C}CH_2\overset{\overset{OH}{|}}{C}HCH_2{-}SO_2{-}CH{=}CH_2 \qquad \text{(VS-16)}$$

$$CH_2{=}CH{-}SO_2{-}CH_2\overset{\overset{OH}{|}}{C}HCH_2\overset{\overset{H}{|}}{N}CH_2\overset{\overset{OH}{|}}{C}HCH_2{-}SO_2{-}CH{=}CH_2 \qquad \text{(VS-17)}$$

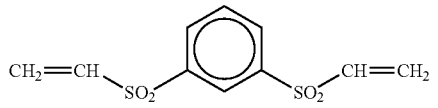

(VS-18)

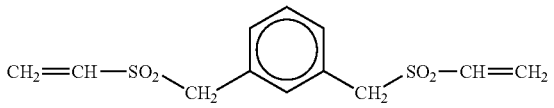

(VS-19)

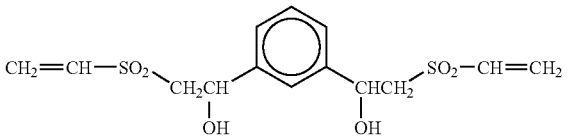

-continued (VS-20)

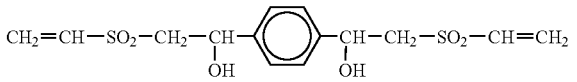

(VS-21)

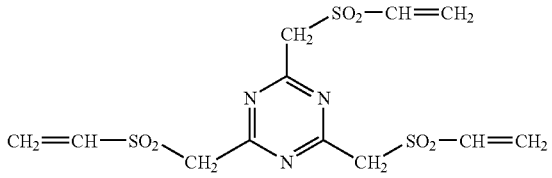

(VS-22)

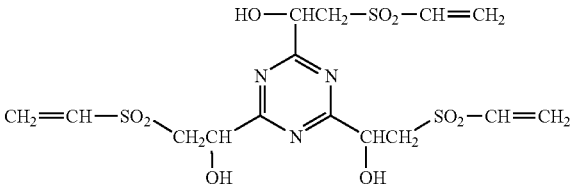

(VS-23)

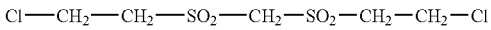

(VS-24)

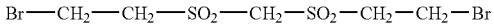

(VS-25)

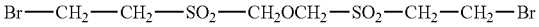

(VS-26)

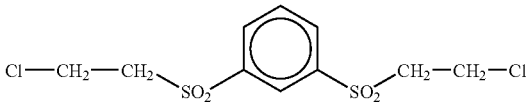

(VS-27)

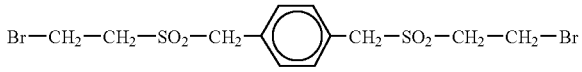

These hardeners may be obtained with reference to the method described in, for example, the specification of U.S. Pat. No. 4,173,481.

Furthermore, as the chlorotriazine-series hardener, a 1,3,5-triazine compound in which at least one of the 2-position, 4-position and 6-position of the triazine ring in the compound is substituted with a chlorine atom, is preferable. A 1,3,5-triazine compound in which two or three of the 2-position, 4-position and 6-position of the triazine ring each are substituted with a chlorine atom, is more preferable. Alternatively, use may be made of a 1,3,5-triazine compound in which at least one of the 2-position, 4-position and 6-position of the triazine ring is substituted with a chlorine atom, and the remainder position(s) is/are substituted with a group(s) or atom(s) other than a chlorine atom. Examples of these other groups include a hydrogen atom, bromine atom, fluorine atom, iodine atom, alkyl group, alkenyl group, alkynyl group, cycloalkyl group, cycloalkenyl group, aryl group, heterocyclic group, hydroxy group, nitro group, cyano group, amino group, hydroxylamino group, alkylamino group, arylamino group, heterocyclic amino group, acylamino group, sulfonamide group, carbamoyl group, sulfamoyl group, sulfo group, carboxyl group, alkoxy group, alkenoxy group, aryloxy group, heterocyclic oxy group, acyl group, acyloxy group, alkyl- or aryl-sulfonyl group, alkyl- or aryl-sulfinyl group, alkyl- or aryl-sulfonyloxy group, mercapto group, alkylthio group, alkenylthio group, arylthio group, heterocyclic thio group and alkyloxy- or aryloxy-carbonyl group.

Specific examples of the chlorotriazine-series hardener include, though not limited to, 4,6-dichloro-2-hydroxy-1,3,5-triazine or its Na salt, 2-chloro-4,6-diphenoxytriazine, 2-chloro-4,6-bis[2,4,6-trimethylphenoxy]triazine, 2-chloro-4,6-diglycidoxy-1,3,5-triazine, 2-chloro-4-(n-butoxy)-6-glycidoxy-1,3,5-triazine, 2-chloro-4-(2,4,6-trimethylphenoxy)-6-glycidoxy-1,3,5-triazine, 2-chloro-4-(2-chloroethoxy)-6-(2,4,6-trimethylphenoxy)-1,3,5-triazine, 2-chloro-4-(2-bromoethoxy)-6-(2,4,6-trimethylphenoxy)-1,3,5-triazine, 2-chloro-4-(2-di-n-butylphosphateethoxy)-6-(2,4,6-trimethylphenoxy)-1,3,5-triazine and 2-chloro-4-(2-di-n-butylphosphateethoxy)-6-(2,6-xylenoxy)-1,3,5-triazine.

Such a compound can be easily produced by reacting cyanur chloride (namely, 2,4,6-trichlorotriazine) with, for example, a hydroxy compound, thio compound or amino compound corresponding to the substituent on the heterocycle.

These hardeners are preferably used in an amount of 0.001 to 1 g, and further preferably 0.005 to 0.5 g, per 1 g of the water-soluble polymer.

<Emulsion>

An emulsion is preferably incorporated in the receptor layer of the heat-sensitive transfer image-receiving sheet of the present invention. The following is a detailed explanation of the emulsion that is preferably used in the present invention.

Hydrophobic additives, such as a releasing agent (herein, also referred to as a lubricant), an antioxidant, and the like, can be introduced into a layer of the image-receiving sheet (e.g. the receptor layer, the heat insulation layer, the undercoat layer), by using a known method described in U.S. Pat. No. 2,322,027, or the like. In this case, a high-boiling organic solvent, as described in U.S. Pat. No. 4,555,470, No. 4,536,466, No. 4,536,467, No. 4,587,206, No. 4,555,476 and No. 4,599,296, JP-B-3-62256, and the like, may be used singly or in combination with a low-boiling organic solvent having a boiling point of 50 to 160° C., according to the need. Also, these releasing agent, antioxidants, and high-boiling organic solvents may be respectively used in combination of two or more.

As the antioxidant (hereinafter, also referred to as a radical trapper in this specification), a compound represented by any one of the following formulae (E-1) to (E-3) is preferably used.

Formula (E-1)

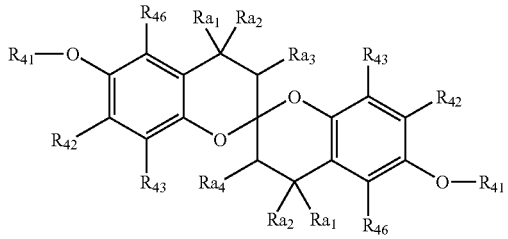

-continued

Formula (E-2)

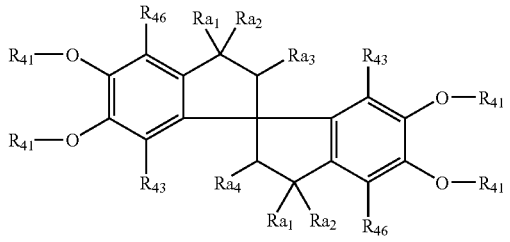

Formula (E-3)

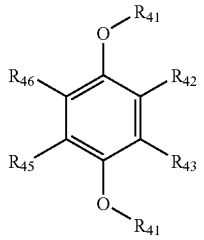

$R_{41}$ represents an aliphatic group, an aryl group, a heterocyclic group, an acyl group, an aliphatic oxycarbonyl group, an aryloxycarbonyl group, an aliphatic sulfonyl group, an arylsulfonyl group, a phosphoryl group, or a group —Si($R_{47}$)($R_{48}$)($R_{49}$) in which $R_{47}$, $R_{48}$ and $R_{49}$ each independently represent an aliphatic group, an aryl group, an aliphatic oxy group, or an aryloxy group. $R_{42}$ to $R_{46}$ each independently represent a hydrogen atom, or a substituent. Examples of the substituent include a halogen atom, aliphatic group (including an alkyl group, alkenyl group, alkynyl group, cycloalkyl group, and cycloalkenyl group), aryl group, heterocyclic group, hydroxy group, mercapto group, aliphaticoxy group, aryloxy group, heterocyclic oxy group, aliphaticthio group, arylthio group, heterocyclic thio group, amino group, aliphaticamino group, arylamino group, heterocyclic amino group, acylamino group, sulfonamide group, cyano group, nitro group, carbamoyl group, sulfamoyl group, acyl group, aliphatic oxycarbonyl group, and aryloxycarbonyl group. $R_{a1}$, $R_{a2}$, $R_{a3}$, and $R_{a4}$ each independently represent a hydrogen atom, or an aliphatic group (for example, methyl, ethyl).

With respect to the compounds represented by any one of the Formulae (E-1) to (E-3), the groups that are preferred from the viewpoint of the effect to be obtained by the present invention, are explained below.

In the Formulae (E-1) to (E-3), it is preferred that $R_4$, represents an aliphatic group, an acyl group, an aliphatic oxycarbonyl group, an aryloxycarbonyl group, or a phosphoryl group, and $R_{42}$, $R_{43}$, $R_{45}$, and $R_{46}$ each independently represent a hydrogen atom, an aliphatic group, an aliphatic oxy group, or an acylamino group. It is more preferred that $R_{41}$, represents an aliphatic group, and $R_{42}$, $R_{43}$, $R_{45}$ and $R_{46}$ each independently represent a hydrogen atom or an aliphatic group.

Preferable specific examples of the compounds represented by any one of the Formulae (E-1) to (E-3) are shown below, but the present invention is not limited to these compounds.

EB-1

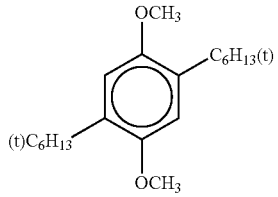

EB-2

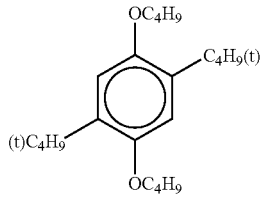

EB-3

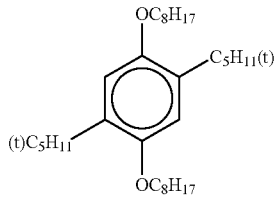

EB-4

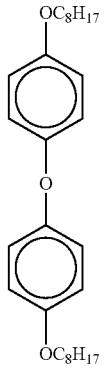

EB-5

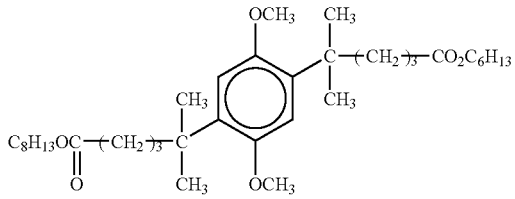

EB-6

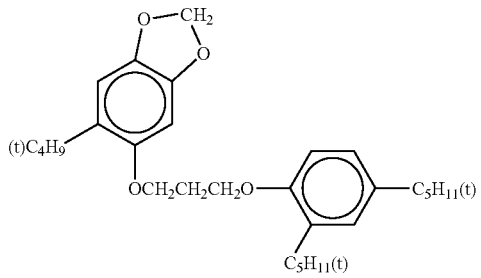

-continued

EB-7

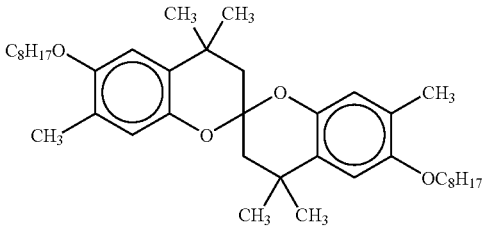

EB-8

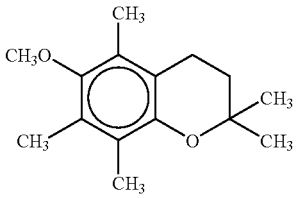

EB-9

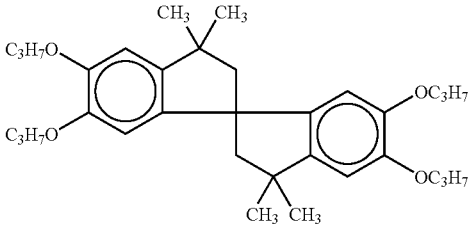

EB-10

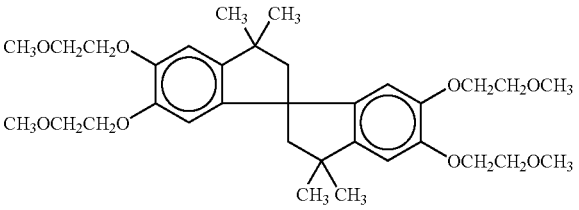

EB-11

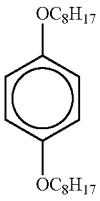

A content of the antioxidizing agent is preferably from 1.0 to 7.0 mass %, more preferably from 2.5 to 5.0 mass %, based on a solid content in the latex polymer.

As the releasing agent (lubricant), solid wax such as polyethylene wax, amide wax and Teflon (registered trademark) powder; silicone oil, phosphate-series compounds, fluorine-based surfactants, silicone-based surfactants and others including releasing agents known in the technical fields concerned may be used. Fluorine-series compounds typified by fluorine-based surfactants, silicone-based surfactants and silicone-series compounds such as silicone oil and/or its hardened products are preferably used. A content of the releasing agent is preferably from 1.0 to 10.0 mass %, more preferably from 1.5 to 2.5 mass %, based on a solid content in the latex polymer.

As the silicone oil as the releasing agent, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, photocurable type, catalyst-curable type, and the like. Among these types, silicone oil that is the reaction-curable type is particularly preferable. As the reaction-curable type silicone oil, products obtained by reacting an amino-modified silicone oil with an epoxy-modified silicone oil and then by curing are preferable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used preferably in an amount of 2 to 4% by mass and further preferably 2 to 3% by mass based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 and KF41-410 (all of these names are trade names, manufactured by Shin-Etsu Chemical Co., Ltd.).

Modified silicones represented by any one of the following Formulae 1 to 3 may also be used.

Formula 1

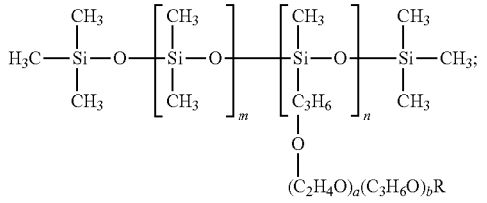

In the Formula 1, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 2

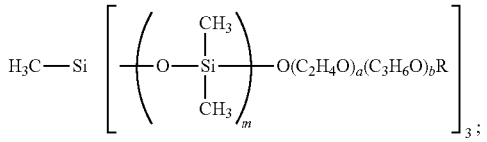

In the Formula 2, R represents a hydrogen atom or a straight-chain or branched alkyl group which may be substituted with an aryl or cycloalkyl group. m denotes an integer of 2,000 or less, and a and b respectively denote an integer of 30 or less.

Formula 3

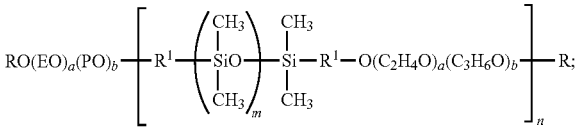

In the Formula 3, R represents a hydrogen atom or a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

Examples of the high-boiling organic solvent include phthalates (e.g., dibutyl phthalate, dioctyl phthalate, di-2-ethylhexyl phthalate), phosphates or phosphonates (e.g., triphenyl phosphate, tricresyl phosphate, tri-2-ethylhexyl phosphate), fatty acid esters (e.g., di-2-ethylhexyl succinate, tributyl citrate), benzoates (e.g., 2-ethylhexyl benzoate, dodecyl benzoate), amides (e.g., N,N-diethyldodecane amide, N,N-dimethylolein amide), alcohols or phenols (e.g., isostearyl alcohol, 2,4-di-tert-amyl phenol), anilines (e.g., N,N-dibutyl-2-butoxy-5-tert-octylaniline), chlorinated paraffins, hydrocarbons (e.g., dodecyl benzene, diisopropyl naphthalene), and carboxylic acids (e.g., 2-(2,4-di-tert-amyl phenoxy)butyrate).

Preferably the compounds shown below are used.

(Solv-1)

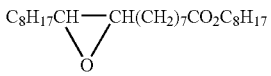

(Solv-2)

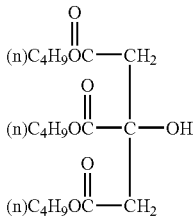

(Solv-3)

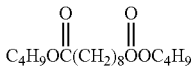

(Solv-4)

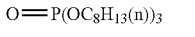

(Solv-5)

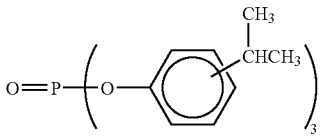

(Solv-6)

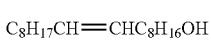

(Solv-7)

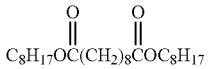

(Solv-8)

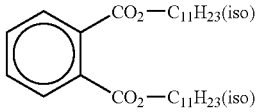

(Solv-9)

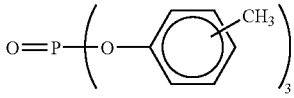

Further, the high-boiling organic solvent may be used in combination with, as an auxiliary solvent, an organic solvent having a boiling point of 30° C. or more and 160° C. or less, such as ethyl acetate, butyl acetate, methyl ethyl ketone, cyclohexanone, methylcellosolve acetate, or the like. The high-boiling organic solvent is used in an amount of generally 10 g or less, preferably 5 g or less, and more preferably 1 to 0.1 g, per 1 g of the hydrophobic additives to be used. The amount is also preferably 1 ml or less, more preferably 0.5 ml or less, and particularly preferably 0.3 ml or less, per 1 g of the binder.

A dispersion method that uses a polymer, as described in JP-B-51-39853 and JP-A-51-59943, and a method wherein the addition is made with them in the form of a dispersion of fine particles, as described in, for example, JP-A-62-30242, can also be used. In the case of a compound that is substantially insoluble in water, other than the above methods, a method can be used wherein the compound is dispersed and contained in the form of fine particles in a binder.

When the hydrophobic compound is dispersed in a hydrophilic colloid, various surfactants may be used. For example, those listed as examples of the surfactant in JP-A-59-157636, page (37) to page (38) may be used. It is also possible to use phosphates-based surfactants described in JP-A-7-56267, JP-A-7-228589, and West German Patent Application Laid-Open (OLS) No. 1,932,299A.

<Ultraviolet Absorber>

Also, in the present invention, in order to improve light resistance, an ultraviolet absorber may be added to the receptor layer. In this case, when this ultraviolet absorber is made to have a higher molecular weight, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339 may be used. As the ultraviolet absorber to be used in a form of a latex, the following commercially available ultraviolet absorbers may be used which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the ultraviolet-absorber-grafted polymer or its latex is preferably 5 to 50 parts by mass, and more preferably 10 to 30 parts by mass, to 100 parts by mass of the receptor latex polymer capable of being dyed to be used to form the receptor layer.

<Releasing Agent>

Also, a releasing agent may be compounded in the receptor layer, in order to prevent thermal fusion with the heat-sensitive transfer sheet when an image is formed. In the first embodiment of the present invention, a releasing agent is compounded in the receptor layer, in order to prevent thermal fusion with the heat-sensitive transfer sheet when an image is formed. As the releasing agent, a silicone oil, a phosphate-based releasing agent (a phosphate-based plasticizer), a fluorine-series compound, or various wax dispersions may be used, and the silicone oil, the wax dispersions and the fluorine-series compound are particularly preferably used.

The addition amount of the releasing agent is determined considering releasing property at the time when the ink sheet is peeled off from the image-receiving sheet after the transfer, which is described hereinafter, a relationship of friction between the ink sheet and the image-receiving sheet that affects to transport property, and influence to other properties to which the releasing agent affects.

The releasing agents are used as a solution or dispersion of them according to the kind of coating solvent for the receptor layer.

The releasing agent may be used singly, or in combination of two or more kinds thereof. Generally, the combination use of two or more kinds thereof often provides advantages from the viewpoint of controlling the releasing property and other properties.

As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil, is preferably used. Among these, a reaction product between vinyl-modified silicone oil and hydrogen-modified silicone oil is preferable. As described above, the addition amount of the releasing agent should be determined also in taking other properties into consideration. The amount of the releasing agent is preferably approximately from 0.2 to 30 parts by mass, per 100 parts by mass of the receptor polymer.

In the present invention, especially in the first embodiment of the present invention, when the receptor layer is formed by a method of using an aqueous coating solution, the silicone oil is preferably used as an emulsified dispersion. In this case, an introduction method of the silicone oil is already explained in the foregoing section of emulsion.

As the wax dispersions, known dispersions may be used. In the present invention, "wax" means an organic compound having an alkyl chain which is in a solid or semisolid state at room temperature (according to the definition given in *Kaitei Wax no Seishitsu to Oyo* (Revised edition, Properties and Applications of Wax), Saiwai Shobo (1989)). Preferable examples of the organic compound include candelilla wax, carnauba wax, rice wax, haze wax, montan wax, ozokerite, paraffin wax, microcrystalline wax, petrolatum, Fischer- Tropsch wax, polyethylene wax, montan wax derivatives, paraffin wax derivatives, microcrystalline wax derivatives, hydrogenated ricinus, hydrogenated ricinus derivatives, 12-hydroxystearic acid, stearic acid amide, phthalic anhydride imide, chlorinated hydrocarbons, and other mixed waxes. Of these waxes, carnauba wax, montan wax and derivatives thereof, paraffin wax and derivatives thereof, microcrystalline wax and derivatives thereof, polyethylene wax and stearic acid amide are preferred; carnauba wax, montan wax and derivatives thereof, microcrystalline wax and stearic acid amide are more preferred; paraffin wax, and paraffin wax derivatives, montan wax, montan wax derivatives and microcrystalline wax are further preferred; and montan wax, montan wax derivatives and microcrystalline wax are furthermore preferred.

The wax is selected from wax having melting points of generally 25° C. to 120° C., preferably 40° C. to 100° C., more preferably 60° C. to 90° C.

The wax is preferably in a state of being dispersed in water, more preferably in the form of fine particles. Dispersing wax in water and forming wax into fine particles can be performed using the methods as described in "Kaitei Wax no Seishitsu to Oyo (Revised version, Properties and Applications of Wax)", Saiwai Shobo (1989).

As described above, the addition amount of the wax should be determined in taking other properties into consideration. The addition amount of wax is preferably from 0.5 to 30% by mass, more preferably from 1 to 20% by mass, and further preferably from 1.5 to 15% by mass, of the amount of total solid content in the receptor layer.

As the fluorine-based releasing agent, there may be used known compounds for providing releasing property. Surfactants having a fluorinated alkyl terminal are widely known as a releasing agent. It is known that the surfactants having a fluorinated alkyl terminal are used as a coating aid.

<Matting Agent>

In the present invention, a matting agent is contained in the receptor layer for controlling surface unevenness, and providing releasing property with the receptor layer.

The present inventors have found that addition of the matting agent and the releasing agent in combination therewith enables to reconcile control of friction between the ink sheet and the image-receiving sheet, and improvement in releasing property of the image-receiving sheet that is released from the ink sheet after transfer. The present invention has been accomplished based on these findings.

In present invention, the matting agent is preferably added to the outermost layer or the layer that functions as the outermost layer or a layer close to the outermost layer on the same side as the image-forming side of the heat-sensitive transfer image-receiving sheet. The outermost layer may be composed of two layers, if necessary. Most preferably, the matting agent is added to the receptor layer disposed as the outermost layer. Besides, the matting agent may be added to an outermost layer at the back side. Alternatively, the matting agent may be added to both the outermost layer on the same side as the image-forming side and the outermost layer at the back side. In the present invention, particularly in the second embodiment of the present invention, it is especially preferred that the matting agent is contained on the same side as the layer containing a sliding agent with respect to the support.

First, the matting agent that can be preferably used in the present invention, particularly in the first embodiment of the present invention, is described below.

In the first embodiment of the present invention, a matting agent contained in the receptor layer may be an inorganic matting agent or an organic matting agent.

Examples of the inorganic matting agent include oxides (e.g., silicon dioxide, titanium oxide, magnesium oxide, aluminum oxide), alkali earth metal salts (e.g., sulfate salts and carbonate salts, specifically barium sulfate, calcium carbonate, magnesium sulfate, strontium sulfate, calcium sulfate), and non-image forming silver halide particles and glass. Further, there may be used inorganic matting agents described in the specification of each of U.S. Pat. Nos. 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245, and 4,029,504. Of these inorganic matting agents, preferred are silicon dioxide, strontium sulfate, barium sulfate, titanium oxide, alumina, silver halide and the like. Especially preferred is silicon dioxide of spherical or indeterminate form.

Examples of the organic matting agent include starch, cellulose esters (e.g., cellulose acetate propionate), cellulose ethers (e.g., ethyl cellulose), gelatin, and synthetic resins. Examples of the synthetic resin include synthetic polymers that are insoluble or sparingly-soluble in a solvent. For example, there can be used various polymers derived from a single use or combination of monomer components such as alkyl acrylate, alkyl methacrylate, alkoxyalkyl acrylate, alkoxyalkyl methacrylate, glycidyl acrylate, glycidyl methacrylate, acrylamidomethacrylamide, vinyl ester, acrylonitrile, olefin, styrene, and benzoguanamine-formaldehyde condensate, or combinations of these monomer components with other monomer components such as acrylic acid, methacrylic acid, α,β-unsaturated dicarboxylic acid, hydroxyethyl acrylate, hydroxyethyl methacrylate, sulfoethyl acrylate, sulfoethyl methacrylate, and styrene sulfonic acid. In addition, there can be also used epoxy resins, nylon, polycarbonates, phenol resins, polyvinyl carbazole, polyvinylidene chloride, and the like. Besides, there can be used various organic matting agents described in the specification of each of U.S. Pat. Nos. 1,055,713, 1,939,213, 2,221,873, 4,268,662, 2,322,037, 2,376,005, and 2,391,181.

In addition, there can be also used various matting agents having a narrow grain size distribution described in JP-A-63-8736 and JP-A-61-230141. Further, there can be also used fluorine atom- or silicon atom-containing particles as described in JP-A-62-14647, JP-A-62-17744 and JP-A-62-17743. Of these organic matting agents, preferred are matting agents of water-dispersible vinyl polymers such as homopolymers of acrylates such as methyl methacrylate, glycidyl acrylate, and glycidyl methacrylate, and copolymers in which these acrylates are mutually combined, or in which these acrylates are combined with another type of vinyl monomers; homopolymers or copolymers of styrene, benzoguanamine-formaldehyde condensate and the like; and melamine resins. Especially preferred are a copolymer of methyl methacrylate/methacrylic acid=95/5 to 40/60, a copolymer of methyl methacrylate/acrylic acid=95/5 to 40/60, and polymers of methyl methacrylate, melamine resins and styrene.

Further, organic/inorganic hybrid fine particles can be also preferably used.

In the present invention, particularly in the first embodiment of the present invention, if necessary, the matting agent may be also used as a mixture of different types of materials in terms of average grain size, size distribution, and shape.

There is no particular limitation in the size and shape of the matting agent, so that matting agents having arbitrary particle diameters can be used. It is preferred in practice of the present invention that matting agents have particle diameters of from 50% to 200%, more preferably from 60% to 150%, based on the thickness of the receptor layer.

The particle diameter distribution of the matting agent may be narrow or wide. However, coefficient of variation of the size distribution is preferably 50% or less, more preferably 40% or less, and furthermore preferably 30% or less. The coefficient of variation herein used indicates a value determined by the following equation:

(Standard deviation of particle diameter)/(average value of particle diameter)×100

Further, it is also preferred to use two types of matting agents each having small coefficient of variation and a ratio of their average particle diameter of more than 3, in combination.

On the other hand, the matting agent greatly affects haze of the coating and surface gloss. Therefore, it is preferred to control the particle diameter, the shape and the particle diameter distribution of the matting agent to the conditions corresponding to necessity by regulating conditions at the time of preparation of the matting agent, or by mixing plural matting agents.

In the present invention, particularly in the first embodiment of the present invention, preferred matting agents are composed of polymers such as the above-described organic compounds. It is especially preferred that the matting agent is a polymer having a glass transition temperature of from 60° C. to 150° C., more preferably from 80° C. to 130° C.

Specific examples of the matting agents preferably used in the present invention, particularly in the first embodiment of the present invention, are set forth below. However, the present invention should not be construed as limiting to the following compounds.

M-1: Polyethylene particles (FLO-BEADS LE-1080 (trade name) manufacture by Sumitomo Seika Chemicals Company Limited)

M-2: Polyethylene particles (FLO-BEADS EA-209 (trade name) manufacture by Sumitomo Seika Chemicals Company Limited)

M-3: Polyethylene particles (FLO-BEADS HE-3040 (trade name) manufacture by Sumitomo Seika Chemicals Company Limited)

M-4: Silicone particles

M-5: Silicone particles (E701 (trade name) manufacture by Dow Corning Toray Co., Ltd.)

M-6: Silicone particles

M-7: Polystyrene particles (SB-6 (trade name) manufacture by SEKISUI PLASTICS CO., LTD.)

M-8: Poly(St/MAA=97/3) copolymer particles

M-9: Poly(St/MAA=90/10) copolymer particles

M-10: Poly(St/MMA/MAA=50/40/10) copolymer particles

M-11: Crosslinked polyethylene particles

M-12: Crosslinked polyethylene particles

M-13: Crosslinked polyethylene particles

M-14: Crosslinked silicone particles

M-15: Crosslinked silicone particles

M-16: Crosslinked silicone particles

M-17: Poly(St/DVB=90/10) particles (SX-713 (trade name) manufactured by Soken Chemical & Engineering Co., Ltd)

M-18: Poly(St/DVB=80/20) particles (SX-713 (trade name) manufactured by Soken Chemical & Engineering Co., Ltd)

M-19: Poly(St/DVB=70/30) particles (SX-713 (trade name) manufactured by Soken Chemical & Engineering Co., Ltd)

M-20: Poly(St/MAA/DVB=87/3/10) copolymer particles (SX-713A (trade name) manufactured by Soken Chemical & Engineering Co., Ltd)

M-21: Poly(St/MAA/DVB=80/10/10) copolymer particles (SX-713B (trade name) manufactured by Soken Chemical & Engineering Co., Ltd)

M-22: Poly(St/MMA/MAA/DVB=40/40/10/10) copolymer particles

M-23: Melamine-silica resin (OPTBEADS 500s (trade name) manufactured by Nissan Chemical Industries, Ltd.)

M-24: Melamine-silica resin (OPTBEADS 2000M (trade name) manufactured by Nissan Chemical Industries, Ltd.)

M-25: Melamine-silica resin (OPTBEADS 3500M (trade name) manufactured by Nissan Chemical Industries, Ltd.)

M-26: Melamine-silica resin (OPTBEADS 6500s (trade name) manufactured by Nissan Chemical Industries, Ltd.)

M-27: Melamine-silica resin (OPTBEADS 10500s (trade name) manufactured by Nissan Chemical Industries, Ltd.)

M-28: Crosslinked PMMA particles (MX series (trade name) manufactured by Soken Chemical & Engineering Co., Ltd)

M-29: Crosslinked PMMA particles (MR series (trade name) manufactured by Soken Chemical & Engineering Co., Ltd)

Abbreviations "St", "DVB", "MAA", "MMA" and "PMMA" herein used indicate styrene, divinylbenzene, methacrylic acid, methyl methacrylate, and poly(methyl methacrylate), respectively.

In the present invention, particularly in the first embodiment of the present invention, the addition amount of the matting agent, as well as the releasing agent, affects releasing property, transport property and other properties, and therefore should be regulated, in addition to that of the releasing agent or the like. In other words, the addition amount should be within such the range that original functions of the layer containing the matting agent are not excessively hindered by the matting agent. Providing that the addition amount of the matting agent is indicated by a coating amount per $m^2$ of the receptor layer, a preferable range is from 1 $mg/m^2$ to 400 $mg/m^2$, more preferably from 5 $mg/m^2$ to 300 $mg/m^2$.

In the case where a matting agent is contained on the same side as the image-forming layer, the addition amount of the matting agent is generally regulated whereby no star dust-like trouble occurs. Specifically in this case, the matting agent is preferably contained so that Bekk smoothness becomes from 500 to 10,000 seconds, and more preferably from 500 to 2,000 seconds. In the case where a matting agent is contained in the back layer, the matting agent is preferably contained so that Bekk smoothness becomes from 10 to 2,000 seconds, and more preferably from 50 to 1,500 seconds. The Bekk smoothness used in the present specification is determined according to JIS P 8119 and TAPPI T479.

Next, the matting agent that can be preferably used in the present invention, particularly in the second embodiment of the present invention, is described below.

In the present invention, especially in the second embodiment of the present invention, it is preferred that a matting agent is previously dispersed with a binder so that the matting agent can be used as a dispersion of matting agent particles.

In the present invention, especially in the second embodiment of the present invention, examples of the matting agent generally include fine particles of water-insoluble organic compounds and fine particles of water-insoluble inorganic compounds. In the second embodiment of the present invention, organic compound-containing fine particles of the particle diameter ranging from 1 to 10 μm are used from the viewpoints of dispersion properties and various effects attained by the present invention. In so far as an organic compound is incorporated in the particles, there may be organic compound particles consisting of the organic compound alone, or alternatively organic/inorganic composite particles containing not only the organic compound but also an inorganic compound. As the matting agent, there can be used those materials well known in the field of silver halide photosensitive materials, such as organic matting agents described in, for example, U.S. Pat. No. 1,939,213, No. 2,701,245, No. 2,322,037, No. 3,262,782, No. 3,539,344, and No. 3,767,448.

In the present invention, especially in the second embodiment of the present invention, examples of the organic compound that can be contained in the matting agent include polymethylmethacrylate resins, polystylene resins, polycarbonate resins, epoxy resins, melamine resins, silicone resins, fluorine resins, benzoguanamine resins, polyacrylate resins, and copolymer resins composed of these polymers such as stylene-acrylate copolymer resins. Of these materials, preferred are matting agents containing polymethylmethacrylate resins, melamine resins, silicone resins, or fluorine resins. More preferred are matting agents containing polymethylmethacrylate resins, or melamine resins. Matting agents containing melamine resins are most preferred.

In the present invention, especially in the second embodiment of the present invention, polymer matting agents are more preferred.

In the present invention, especially in the second embodiment of the present invention, the shape of the matting agents is not limited in particular, and arbitrary shaped matting agents may be used. As a particle diameter (average particle diameter) of the matting agents, particles ranging from 1 μm to 10 μm are generally used from the viewpoint of giving unevenness to the surface in the practice of the present invention and the viewpoint of effects to be attained by the present invention. A more preferable particle diameter of the matting agent is in the range of from 1 μm to 8 μm, and furthermore preferably from 2 μm to 7 μm. The particle diameter distribution of the matting agent may be narrow or wide. However, coefficient of variation of the particle diameter distribution is preferably 50% or less, more preferably 40% or less, and furthermore preferably 30% or less. The coefficient of variation herein used indicates a value determined by the following equation:

$$(\text{Standard deviation of particle diameter})/(\text{average value of particle diameter})\times 100$$

Further, it is also preferred to use two types of matting agents having small coefficient of variation and different their average particle diameters.

On the other hand, the matting agent greatly affects haze of the coating and surface gloss. Therefore, it is preferred to control the particle diameter, the shape and the particle diameter distribution of the matting agent to the conditions corresponding to necessity by regulating conditions at the time of preparation of the matting agent, or by mixing of plural matting agents.

Besides, if necessary, the matting agent for use in the present invention, particularly in the second embodiment of the present invention, can be used as a mixture with another kind of particles that are different in average particle diameter, size distribution and/or shape from said matting agent.

It is preferred that the matting agent has a heat resistance because a surface temperature of the receptor layer becomes high at the time of graphic printing.

In the present invention, especially in the second embodiment of the invention, a preferable matting agent contains a polymer such as the above-described organic compounds. It is preferred that the polymer has a glass transition temperature of 90° C. or more, more preferably 130° C. or more.

In the present invention, especially in the second embodiment of the invention, a preferable matting agent is composed of the polymer such as the above-described organic compounds, in which the polymer has a thermal decomposition temperature of 200° C. or more, more preferably 240° C. or more.

Besides, a hard matting agent is preferred because not only heat but also pressure is applied to the surface of the receptor layer at the time of graphic printing.

Specific examples of the matting agents preferably used in the present invention, particularly in the second embodiment of the present invention, are set forth below. However, the present invention should not be construed as limiting to the following compounds.

2M-1: Silicone particles, specific gravity: 0.97

2M-2: Silicone particles, specific gravity: 1.00 (E701 (trade name) manufacture by Dow Corning Toray Co., Ltd.)

2M-3: Silicone particles, specific gravity: 1.03

2M-4: Polystyrene particles, specific gravity: 1.05 (SB-6 (trade name) manufacture by SEKISUI PLASTICS CO., LTD.)

2M-5: Poly(St/MAA=97/3) copolymer particles, specific gravity: 1.05

2M-6: Poly(St/MAA=90/10) copolymer particles, specific gravity: 1.06

2M-7: Poly(St/MMA/MAA=50/40/10) copolymer particles, specific gravity: 1.09

2M-8: Crosslinked silicone particles, specific gravity: 0.99

2M-9: Crosslinked silicone particles, specific gravity: 1.02

2M-10: Crosslinked silicone particles, specific gravity: 1.04

2M-11: Poly(St/DVB=90/10) particles, specific gravity: 1.06 (SX-713 (trade name) manufactured by Soken Chemical & Engineering Co., Ltd)

2M-12: Poly(St/DVB=80/20) particles, specific gravity: 1.06 (SX-713 (trade name) manufactured by Soken Chemical & Engineering Co., Ltd)

2M-13: Poly(St/DVB=70/30) particles, specific gravity: 1.07 (SX-713 (trade name) manufactured by Soken Chemical & Engineering Co., Ltd)

2M-14: Poly(St/MAA/DVB=87/3/10) copolymer particles, specific gravity: 1.06 (SX-713 A (trade name) manufactured by Soken Chemical & Engineering Co., Ltd)

2M-15: Poly(St/MAA/DVB=80/10/10) copolymer particles, specific gravity: 1.07 (SX-713B (trade name) manufactured by Soken Chemical & Engineering Co., Ltd)

2M-16: Poly(St/MMA/MAA/DVB=40/40/10/10) copolymer particles, specific gravity: 1.10

2M-17: Melamine-silica resin, specific gravity: 1.65 (OPTBEADS 500s (trade name) manufactured by Nissan Chemical Industries, Ltd.)

2M-18: Melamine-silica resin, specific gravity: 1.65 (OPTBEADS 2000M (trade name) manufactured by Nissan Chemical Industries, Ltd.)

2M-19: Melamine-silica resin, specific gravity: 1.65 (OPTBEADS 3500M (trade name) manufactured by Nissan Chemical Industries, Ltd.)

2M-20: Melamine-silica resin, specific gravity: 1.65 (OPTBEADS 6500s (trade name) manufactured by Nissan Chemical Industries, Ltd.)

2M-21: Melamine-silica resin, specific gravity: 1.65 (OPTBEADS 10500s (trade name) manufactured by Nissan Chemical Industries, Ltd.)

2M-22: Crosslinked PMMA particles (MX series (trade name) manufactured by Soken Chemical & Engineering Co., Ltd)

2M-23: Crosslinked PMMA particles (MR series (trade name) manufactured by Soken Chemical & Engineering Co., Ltd)

Abbreviations "St", "MAA", "MMA", "DVB" and "PMMA" herein used indicate styrene, methacrylic acid, methyl methacrylate, divinylbenzene, and poly(methyl methacrylate), respectively.

It is preferred that the matting agent preferably contained in the outermost layer and a layer adjacent to the outermost layer on the same side as an image-forming layer is previously dispersed with a binder and used as a dispersion of matting agent particles. As the method for dispersion, there are two methods, namely (a) a method of preparing dispersions of the matting agent, comprising the steps of preparing a solution of a polymer to be as a matting agent (for example, dissolving the polymer in a low boiling-point solvent), emulsifying and dispersing the solution in an aqueous medium to obtain droplets of the polymer, and then eliminating the low boiling-point solvent from the resultant emulsion, and (b) a method of preparing of dispersions, comprising the steps of previously preparing fine particles, including a polymer, to be as a matting agent, and then dispersing the fine particles in an aqueous medium while preventing from generation of aggregate. In the present invention, preferred is the method (b) that does not discharge such a low boiling-point solvent to environments from the environmental concern.

In the method of dispersing matting agent as described above, the matting agent may be mechanically dispersed in the presence of an aqueous medium previously containing a binder as a dispersion aid using a known high speed agitation means (e.g., dissolver emulsifier, homomixer, turbine mixer, and homogenizer), ultrasonic emulsifier or the like. At the time of dispersion, these machines may be used together with a means for dispersing the matting agent under the condition of pressure reduction lower than atmosphere so as to prevent from generation of bubbles. With respect to the dispersion aid used in the dispersion method, it is a general method to previously dissolve the dispersion aid in an aqueous medium and then add the matting agent to the resultant aqueous medium. However, aqueous dispersions of the matting agent previously obtained by polymerization may be added as it is, namely without through a drying step. The dispersion aid may be added to the aqueous dispersions during dispersion. Besides, the dispersion aid may be added to the aqueous dispersions in order to stabilize physical properties after dispersion. In any case, it is ordinary that dispersion is performed in the presence of a solvent (for example, water and alcohol). Before and after dispersion, or during dispersion, pH may be controlled using a suitable pH regulator.

In addition to the means for mechanical dispersion, stabilization of dispersions of the matting agent after dispersion may be improved by control of pH. Further, an extremely small amount of a low boiling-point organic solvent may be auxiliarily used for dispersion. But, ordinarily, the low boiling-point organic solvent is eliminated after completion of preparation of the fine particles.

The thus-prepared dispersions may be stored with stirring, or alternatively may be stored under the conditions of high viscosity using a hydrophilic colloid (for example, to jellify using gelatin), in order to prevent from deposition of the matting agent during storage. Further, antiseptics are preferably added to the dispersions in order to prevent from proliferation of various germs, or the like, during storage.

The binder is preferably added and dispersed in an amount of from 5 to 300 mass %, more preferably from 10 to 200 mass %, based on the matting agent.

To the dispersions of the matting agent in the present invention, a surfactant is preferably added for stabilization of the dispersed state. In the present invention, particularly in the first embodiment of the present invention, the kind of surfactant herein used is not particularly limited, but surfactants having at least one fluorine atom are preferred.

The amount of the receptor layer to be applied is preferably 0.5 to 10 g/m$^2$ (solid basis, hereinafter, the amount to be applied in the present specification means a value on solid basis unless otherwise noted), more preferably 1 to 8 g/m$^2$, and further preferably 2 to 7 g/m$^2$. The film thickness of the receptor layer is preferably 1 to 20 μm.

<Control of Releasing Property Between the Ink Sheet and the Image-Receiving Sheet at the Time when they are Separated from Each Other after Transfer, and Friction Between the Ink Sheet and the Image-Receiving Sheet that Affects Transport Property>

The releasing property between the ink sheet and the image-receiving sheet at the time when they are separated from each other after transfer depends on the addition amount of the releasing agent, and the property is improved as the addition amount is increased. On the other hand, as the addition amount of the releasing agent increases, the friction between the ink sheet and the image-receiving sheet becomes lower. Thereby, transport property of the ink sheet are sometimes adversely affected.

As a result of studies, the present inventors have found that in the present invention, particularly in the first embodiment of the present invention, it is necessary, for prevention of adverse influence to the transport property of the ink sheet, that coefficient of static friction be controlled in the range of 0.280 or more between the ink sheet and the surface of the image-receiving sheet with which the ink sheet contacts at the time of transport.

That is, in the present invention, particularly in the first embodiment of the present invention, in the case where image formation is performed by superposing, in relation of face to face, a heat-sensitive transfer image-receiving sheet on a heat-sensitive transfer sheet having at least 2-color ink layers successively formed, it is preferred to prepare the heat-sensitive transfer image-receiving sheet so that coefficient of static friction becomes within the range of 0.280 or more between a surface of the ink layer to be transferred at the first time of image formation and an untransferred surface of the receptor layer of the heat-sensitive transfer image-receiving sheet. Further, it is more preferred to prepare the heat-sensitive transfer image-receiving sheet so that coefficient of static friction becomes within the range of 0.280 or more between a surface of the ink layer to be transferred at the second time or later of image formation and the surface of the receptor layer of the heat-sensitive transfer image-receiving sheet to which ink was transferred at the maximum density before this ink layer is transferred.

On account of the restriction that the surface of the image-receiving sheet is regulated in such the range, the amount of the releasing agent that can be added to the receptor layer is limited. Consequently, it is sometimes difficult to obtain sufficient releasing property. As a result of more intensive studies, the present inventors have found that addition of the matting agent enables to neutralize a dependency of friction between the ink sheet and the image-receiving sheet upon the addition amount of the releasing agent.

In other words, addition of the matting agent in a specific amount to the receptor layer enables to increase the addition amount of the releasing agent, which results in maintenance of sufficient releasing property. Consequently, there can be achieved compatibility of maintenance of sufficient releasing property and "0.280 or more" in terms of coefficient of static friction between the ink sheet and the surface of the image-receiving sheet with which the ink sheet contacts at the time of transport, that is the requisitions for prevention from adverse influence to the transport property of the ink sheet.

In the present invention, particularly in the first embodiment of the present invention, the addition of the matting agent decreases friction between the ink sheet and the image-receiving sheet. Therefore, it is necessary to adjust the addition amount of the matting agent so as to satisfy the above-described relation.

The coefficient of static friction between the ink sheet and the surface of the image-receiving sheet with which the ink sheet contacts at the time of transport can be measured using a static friction meter ordinarily sold on the market (for example, measuring apparatus for coefficient of static friction TYPE: 10, manufactured by Shinto Scientific). Measurement is conducted to determine the coefficient of static friction between the ink face that is transferred at the first time of image formation and the untransferred surface of an image-receiving layer of the heat-sensitive transfer image-receiving sheet, and also the coefficient of static friction between the surface of an image-receiving layer of the heat-sensitive transfer image-receiving sheet to which ink was already transferred and the ink surface that is to be transferred in the next time.

The releasing property between the ink sheet and the image-receiving sheet at the time of release after transfer can be evaluated by actually loading an ink sheet and an image-receiving sheet into a sublimation type printer and then outputting them, followed by observation of releasing noise at the time of printing, uniformity of the print and the released state in the printer. However, in the model experimentation, the releasing property can be evaluated by superposing the image-receiving sheet on the ink sheet in the relation of face to face and then welding them with heat and pressure, followed by measurement of load at the time of separation from each other.

(Heat Insulation Layer)

In the present invention, the heat-sensitive transfer image-receiving sheet is preferably provided with a heat insulation layer. The heat insulation layer serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a substrate (support). The heat insulation layer may be a single layer, or multi-layers. The heat insulation layer is generally arranged at a nearer location to the support than the receptor layer.

In the image-receiving sheet of the present invention, the heat insulation layer particularly preferably contains hollow polymer particles.

The hollow polymer particles in the present invention are polymer particles having independent pores inside of the particles. Examples of the hollow polymer particles include (1) non-foaming type hollow particles obtained in the following manner: a dispersion medium such as water is contained inside of a capsule wall formed of a polystyrene, acryl resin, or styrene/acryl resin and, after a coating solution is applied and dried, the dispersion medium in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 2 μm, further preferably 0.1 to 1 μm, particularly preferably 0.2 to 0.8 μm. It is because an excessively small size may lead to decrease of the void ratio (hollow ratio) of the particles, prohibiting desirable heat-insulating efficiency, while an excessively large size in relation to the thickness of the heat insulation layer may result in problems for preparation of smooth surface and cause coating troubles due to the bulky particles.

In the present invention, particularly in the second embodiment of the present invention, these hollow polymer particles preferably have a hollow ratio of about 20 to 70%, more preferably 20 to 50%. With too small hollow ratio, it cannot give a sufficient heat-insulating efficiency, while with an excessively large hollow ratio for the hollow particles that have the above-described preferable particle diameter, imperfect hollow particles increase prohibiting sufficient film strength.

The hollow ratio (%) of hollow polymer particles in the present invention is determined by taking a transmission electron microscope photograph of at least 300 hollow polymer particles, measuring the circle-equivalent diameter of the void (hollow) in each particle and the diameter of the hollow polymer particle, calculating individual hollow ratio (%) from the measured values according to the following formula, and averaging the individual hollow ratios:

$$\text{Individual hollow ratio (\%)} = (\text{Circle-equivalent diameter of void})^3/(\text{Diameter of hollow polymer particle})^3 \times 100$$

The glass transition temperature (Tg) of the hollow polymer particles is preferably 70° C. or more and more preferably 100° C. or more. These hollow polymer particles may be used in combinations of two or more.

Such hollow polymer particles are commercially available. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). Among these, the hollow polymer particles of the above (1) may be preferably used.

A water-dispersible resin or water-soluble type resin is preferably used, as a binder, in the heat insulation layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures.

The solid content of the hollow polymer particles in the heat insulation layer preferably falls in a range from 5 to 2,000 parts by mass, more preferably 5 to 1000 parts by mass, and further preferably 5 to 400 parts by mass, assuming that the solid content of the binder resin be 100 parts by mass. The solid content of the hollow polymer particles is preferably 50% by mass or more, more preferably 60% by mass or more, and further preferably 65% by mass or more, based on the total solid content of the hollow polymer particles and the binder resin. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, and thereby sufficient film strength cannot be obtained, causing deterioration in abrasion resistance.

The heat insulation layer of the heat-sensitive transfer image-receiving sheet of the present invention is preferably free of any resins that are not resistant to an organic solvent, except for the hollow polymer particles. Incorporation of the resin that is not resistant to an organic solvent (resin having a dye-dyeing affinity) in the heat insulation layer is not preferable in view of increase in loss of image definition after image transfer. It is assumed that the color-edge definition loss increases by the reason that owing to the presence of both the resin having a dye-dyeing affinity and the hollow polymer particles in the heat insulation layer, a transferred dye that has dyed the receptor layer migrates through the heat insulation layer adjacent thereto with the lapse of time.

Herein, the term "the resin that is not resistant to an organic solvent" means a resin having a solubility in an organic solvent (e.g., methyl ethyl ketone, ethyl acetate, benzene, toluene, xylene) of 1 mass % or more, preferably 0.5 mass % or more. For example, the above-mentioned latex polymer is included in the category of "the resin that is not resistant to an organic solvent".

The water-soluble polymer used in the heat-insulating layer is preferably any of the water-soluble polymers described above as those used in the receptor layer. Preferable compounds of the water-soluble polymer are the same as mentioned above.

An amount of the water-soluble polymer to be added in the heat insulation layer is preferably from 1 to 75 mass %, more preferably from 1 to 50 mass % to the entire heat insulation layer.

The heat insulation layer preferably contains a gelatin. The amount of the gelatin in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

Also, the water-soluble polymer that is contained in the heat insulation layer has been preferably cross-linked with a crosslinking agent. Preferable compounds as well as a preferable amount of the crosslinking agent to be used are the same as mentioned above.

A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

A thickness of the heat insulation layer containing the hollow polymer particles is preferably from 5 to 50 μm, more preferably from 5 to 40 μm.

A void ratio (porosity ratio) of the heat insulation layer, which is calculated from the thickness of the heat insulation layer containing hollow polymer particles and the solid-matter coating amount of the heat insulation layer including the hollow polymer particles, is preferably 10 to 70% and more preferably 15 to 60%. When the void ratio is too low, sufficient heat insulation property cannot be obtained. When the void ratio is too large, the binding force among hollow polymer particles deteriorates, and thus sufficient film strength cannot be obtained, and abrasion resistance deteriorates.

The void ratio of the heat insulation layer as referred to here is a value V calculated according to the Formula (b) below.

$$V=1-L/L\times\Sigma gi-di \qquad \text{Formula (b)}$$

In Formula (b), L represents the thickness of the heat-insulating layer; gi represents the coating amount of a particular material i in terms of solid matter for the heat-insulating layer; and di represents the specific density of the particular material i. When di represents the specific density of the hollow polymer particles, di is the specific density of the wall material of hollow polymer particles.

(Undercoat Layer)

An undercoat layer may be formed between the receptor layer and the heat insulation layer. As the undercoat layer, for example, at least one of a white background controlling layer, a charge controlling layer, an adhesive layer, and a primer layer is formed. These layers may be formed in the same manner as those described in, for example, each specification of Japanese Patent Nos. 3585599 and 2925244.

(Support)

In the present invention, any known support can be used. The use of the waterproof support makes it possible to prevent the support from absorbing moisture, whereby a fluctuation in the performance of the receptor layer with time can be prevented. As the waterproof support, for example, coated paper or laminate paper may be used.

-Coated Paper-

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper and the like. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

-Laminated Paper-

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

The method of producing the heat-sensitive transfer image-receiving sheet of the present invention is explained below.

The heat-sensitive transfer image-receiving sheet of the present invention can be preferably formed, by applying at least one receptor layer, at least one intermediate layer and at least one heat-insulating layer, on a support, through simultaneous multi-layer coating.

In the present invention, particularly in the second embodiment of the present invention, it is preferred to coat the above-described receptor layer and a layer adjacent to the receptor layer at the same time for production. It is more preferred that the above-described adjacent layer is a heat insulation layer.

It is known that in the case of producing an image-receiving sheet composed of plural layers having different functions from each other (for example, an air cell layer, a heat insulation layer, an intermediate layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, it has been found that the productivity is greatly improved and, at the same time, image defects can be remarkably reduced, by using the above simultaneous multilayer coating for the production of an image-receiving sheet having a multilayer structure.

The plural layers in the present invention are structured using resins as its major components. Coating solutions forming each layer are preferably water-dispersible latexes. The solid content by mass of the resin put in a latex state in each layer coating solution is preferably in a range from 5 to 80% and particularly preferably 20 to 60%. The average particle diameter of the resin contained in the above water-dispersed latex is preferably 5 μm or less and particularly preferably 1 μm or less. The above water-dispersed latex may contain a known additive, such as a surfactant, a dispersant, and a binder resin, according to the need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Also, in the case where a binder (e.g., a gelatin) to be gelled at lower temperatures is contained, there is the case where it is preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

A heat-sensitive transfer sheet (ink sheet) used in combination with the heat-sensitive transfer image-receiving sheet according to the present invention as mentioned above at the time of formation of heat transfer image is preferably a sheet having, on a support, a dye layer containing a diffusion-transfer dye, and any ink sheet can be used as the sheet. As a means for providing heat energy in the thermal transfer, any of the conventionally known providing means may be used. For example, application of a heat energy of about 5 to 100 mJ/mm$^2$ by controlling recording time in a recording device such as a thermal printer (trade name: Video Printer VY-100, manufactured by Hitachi, Ltd.), sufficiently attains the expected result.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The present invention can be applied to a printer, a copying machine and the like, each of which uses a heat-sensitive transfer recording system.

According to the present invention, it is possible to provide a heat-sensitive transfer image-receiving sheet provided with high speed printing suitability, an image-forming method using a heat-sensitive transfer system, and a method of producing the heat-sensitive transfer image-receiving sheet.

In particular, according to the first embodiment of the present invention, it is possible to a heat-sensitive transfer image-receiving sheet that is excellent in releasing property and transport property, and has a high image quality such as high graininess of the image and few or no transfer unevenness; an image-forming method using a heat-sensitive transfer system; and a method of producing the heat-sensitive transfer image-receiving sheet. In addition, according to the second embodiment of the present invention, it is possible to a heat-sensitive transfer image-receiving sheet by which a high grade image quality, such as high graininess of the image and few or no transfer unevenness, is obtained; and a method of producing the heat-sensitive transfer image-receiving sheet.

According to the present invention, it is possible to provide a heat-sensitive transfer image-receiving sheet excellent in releasing property by which a high grade image quality (high graininess of the image and few or no transfer unevenness) is obtained; an image-forming method using a heat-sensitive transfer system, and a method of producing the heat-sensitive transfer image-receiving sheet.

The present invention will be described in more detail based on the following examples, but the invention is not intended to be limited thereto.

EXAMPLES

In the following Examples, the terms "part" and "%" are values by mass, unless they are indicated differently in particular.

Example 1

Ink Sheet

As an ink sheet, an ink ribbon for exclusive use of a sublimation type printer ASK-2000 (trade name) manufactured by FUJI FILM Corporation, was used.

(Preparation of Image-Receiving Sheet)

(Preparation of Support)

A pulp slurry was prepared from 50 parts by mass of hardwood bleach kraft pulp (LBKP) of acacia origin and 50 parts by mass of LBKP of aspen origin, by beating these pulps by means of a disk refiner until Canadian standard freeness reached to 300 ml.

To the pulp slurry thus prepared were added, on a pulp basis, 1.3 mass % of modified cationic starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 157 g/m$^2$, and the raw paper (base paper) having a thickness of 160 μm was obtained.

The wire side (back side) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene having an MFR of 4.0 g/10 min and a density of 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side"). The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating had a dry mass of 0.2 g/m$^2$. Subsequently, the front surface (front side) of the base paper was subjected to corona discharge treatment, and then coated with 27 g/m$^2$ of a low-density polyethylene having an MFR of 4.0 g/10 min and a density of 0.93 g/m$^3$ and containing 10 mass % of titanium oxide, by means of a melt extruder, thereby forming a thermoplastic resin layer with a specular surface.

(Preparation of Heat-Sensitive Transfer Image-Receiving Sheet 101)

Coating Solution for Heat Insulation Layer

| (Composition) | |
|---|---|
| Hollow latex polymer particles (MH5055 (trade name), manufactured by Zeon Corporation) | 38 parts by mass |
| 16% Gelatin aqueous solution | 26 parts by mass |
| Water | 4 parts by mass |
| NaOH for adjusting pH to 8 | |
| (Coating amount) 45 ml/m$^2$ | |

Coating Solution for Receptor Layer

| (Composition) | |
|---|---|
| Vinyl chloride-acrylate latex (VINYBLAN 900 (trade name), manufactured by Nissin Chemical Industry Co., Ltd.) | 44 parts by mass |
| Vinyl chloride-acrylate latex (VINYBLAN 276 (trade name), manufactured by Nissin Chemical Industry Co., Ltd.) | 27 parts by mass |
| 16% Gelatin aqueous solution | 3.5 parts by mass |
| Releasing agent, Microcrystalline wax (EMUSTAR-42X (trade name), manufactured by Nippon Seiro Co., Ltd.) | 6 parts by mass |
| Matting agent, PMMA particles (particle diameter: 3.5 μm) | 1.5 parts by mass |
| Water | 30 parts by mass |
| The following compound A | 0.05 part by mass |
| NaOH for adjusting pH to 8 | |
| (Coating amount) 10 ml/m$^2$ | |

Compound A

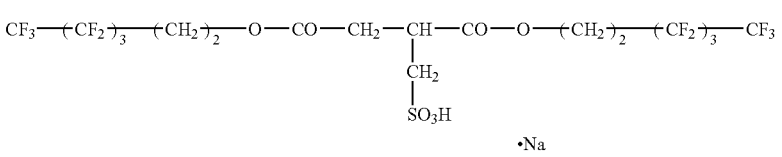

A sample was prepared by simultaneous multi-layer coating, so as to form a multiple-layer structure, on the support prepared in the foregoing manner, having a subbing layer, a heat insulation layer, and a receptor layer, in increasing order of distance from the support. Compositions and application amounts of the coating solutions used herein are shown below.

Coating Solution for Subbing Layer

| (Composition) | |
|---|---|
| Styrene/butadiene latex (SR103 (trade name), manufactured by Nippon A & L Inc.) | 93 parts by mass |
| 8.7% Aqueous solution of polyvinyl alcohol (PVA) | 57 parts by mass |
| NaOH for adjusting pH to 8 | |
| (Coating amount) 21 ml/m$^2$ | |

Immediately before coating, a compound B (cross-linking agent) illustrated below was added to the foregoing receptor layer coating solution. The amount of the compound B added was adjusted to 3 mass % based on the total mass of gelatin in the heat-insulating layer and the receptor layer. The thickness of the receptor layer was 5.8 μm.

Compound B

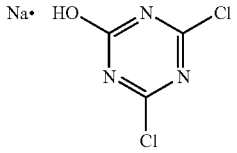

(Preparation of Heat-Sensitive Transfer Image-Receiving Sheets 102 to 118)

Heat-sensitive transfer image-receiving sheets 102 to 118 were prepared in the same manner as the heat-sensitive transfer image-receiving sheet 101, except for replacing the releasing agent and the matting agent by compounds as shown in Table 1.

Each of the addition amounts of the releasing agent and the matting agent was also changed as shown in Table 1. The addition amount of water was changed for adjustment so as not to change coating amounts of the materials other than water. In each of the heat-sensitive transfer image-receiving sheets 102 to 118, the thickness of the receptor layer was 5.8 μm.

TABLE 1

| Sample No | Kind of matting agent (Particle diameter) | Addition amount of matting agent (mass parts) | Kind of releasing agent | Addition amount of releasing agent (mass parts) | Remarks |
|---|---|---|---|---|---|
| 101 | PMMA (3.5 μm) | 1.5 | Microcrystalline wax, EMUSTAR-042X (trade name, manufactured by Nippon Seiro Co., Ltd.) | 6 | This invention |
| 102 | " | " | Microcrystalline wax, EMUSTAR-042X (trade name, manufactured by Nippon Seiro Co., Ltd.) | 4.5 | This invention |
| 103 | " | " | Microcrystalline wax, EMUSTAR-042X (trade name, manufactured by Nippon Seiro Co., Ltd.) | 3 | This invention |
| 104 | " | " | Microcrystalline wax, EMUSTAR-042X (trade name, manufactured by Nippon Seiro Co., Ltd.) | 1.5 | This invention |
| 105 | " | " | Montanate wax, J-537 (trade name, manufactured by CHUKYO YUSHI. CO., LTD.) | 6 | This invention |
| 106 | " | " | Montanate wax, J-537 (trade name, manufactured by CHUKYO YUSHI. CO., LTD.) | 3 | This invention |
| 107 | PMMA (6.5 μm) | " | EMUSTAR-042X | 3 | This invention |
| 108 | PMMA (3.5 μm) | 3 | " | 3 | This invention |
| 109 | Silica particles (4 μm) | 1.5 | " | 3 | This invention |
| 110 | No matting agent was added. | 0 | " | 6 | Comparative example |
| 111 | No matting agent was added. | " | " | 4.5 | Comparative example |
| 112 | No matting agent was added. | " | " | 3 | Comparative example |
| 113 | PMMA (10 μm) | 1.5 | " | 3 | This invention |
| 114 | PMMA (15 μm) | 1.5 | " | 3 | Comparative example |
| 115 | M-25 (3.5 μm) | 1.5 | " | 3 | This invention |
| 116 | M-25 (3.5 μm) | 1.5 | Dispersion of dipentaerythritol hexaisostearate | 3 | This invention |
| 117 | PMMA (3.5 μm) | 1.5 | No releasing agent was added. | 0 | Comparative example |
| 118 | No matting agent was added. | 0 | No releasing agent was added. | 0 | Comparative example |

(Image Formation)

The ink sheet and any of the heat-sensitive transfer image-receiving sheets 101 to 118 were each worked so as to become loadable, and a printed output was produced on each combination of the ink sheet and any of the image-receiving sheets, in a high-speed print mode under the condition of 35° C. and a humidity of 70%, by use of a sublimation-type thermal transfer printer ASK2000 (trade name, manufactured by FUJIFILM Corporation). The heat-sensitive transfer image-receiving sheets were loaded into the printer after moisture conditioning under the condition of 35° C. and a humidity of 70% for 2 hours. For output images, two kinds of images set forth below were used.

1) High density whole black image (black solid image)

2) Test pattern having gradation images of from white to the maximum density of various monochromes and gray Each of these two types of images was output successively to obtain 30 sheets of copy, respectively.

Herein, in the high-speed print mode, the time interval between ejection of one printed piece and ejection of the next one was 8 seconds.

(Evaluation of Releasing Property)

A yellow (Y) ink surface of the ink sheet and each of the heat-sensitive transfer image-receiving sheets 101 to 118 were processed to the form of 5 cm squares and superposed so that transferable surfaces thereof can be confronted with each other. After close contacting them with load of 2 kg weight at 90° C., the ink sheet and the image-receiving sheet were peeled from each other under the condition of 90° C., and a load applied for the peeling was determined. The releasing angle and the releasing speed were set to be 180° and 5 cm/s, respectively. The load at the time when releasing was accomplished by approximately uniform loading was determined. A mean value of the load was used for evaluation as peeling force.

Further, releasing property was also evaluated examining the state of output image explained in the proceeding section of image formation.

(Evaluation of Transport Property)

Using a static friction coefficient measuring instrument, TYPE: 10, manufactured by Shinto Kagaku Co., Ltd., measurements were carried out with respect to the coefficient of static friction between the Y surface of the ink sheet and the image-forming surface of each of the heat-sensitive transfer image-receiving sheets 101 to 118, and the coefficient of static friction between the magenta (M) surface of the ink sheet and the surface of Y solid image formed by image formation after loading each of the heat-sensitive transfer image-receiving sheets 101 to 118 and the ink sheet in the sublimation type printer ASK-2000 (this surface of Y solid image was formed by stopping the image formation immediately after Y transfer). When the value of coefficient of static friction was less than 0.28, the transport property was impaired.

The results obtained by each evaluation are shown in Table 2 set forth below.

TABLE 2

| Sample No | Releasing property (Peeling force, kgf/cm) | Transport property (Coefficient of static friction) Upper: Untransferred surface Lower: Y solid image surface | Image Upper: Releasing property Lower: Transport property | Remarks |
|---|---|---|---|---|
| 101 | 12 | 0.352<br>0.310 | No problem<br>No problem | This invention |
| 102 | 16 | 0.350<br>0.310 | No problem<br>No problem | This invention |
| 103 | 24 | 0.353<br>0.320 | Slight sticking<br>No problem | This invention |
| 104 | 28 | 0.352<br>0.315 | Slight sticking<br>No problem | This invention |
| 105 | 16 | 0.351<br>0.312 | No problem<br>No problem | This invention |
| 106 | 28 | 0.349<br>0.308 | Slight sticking<br>No problem | This invention |
| 107 | 22 | 0.330<br>0.292 | No problem<br>No problem | This invention |
| 108 | 22 | 0.335<br>0.295 | No problem<br>No problem | This invention |
| 109 | 24 | 0.340<br>0.301 | Slight sticking<br>No problem | This invention |
| 110 | 14 | 0.280<br>0.242 | No problem<br>Frequent occurrence of jam | Comparative example |
| 111 | 17 | 0.299<br>0.262 | No problem<br>Occurrence of shear in transfer | Comparative example |
| 112 | 36 | 0.351<br>0.310 | Frequently sticking<br>Occasional occurrence of jam | Comparative example |
| 113 | 20 | 0.321<br>0.281 | No problem<br>No problem | This invention |
| 114 | Out measurement<br>No definite value was obtained. | 0.300<br>0.262 | Partially frequently sticking<br>Occasional occurrence of jam | Comparative example |
| 115 | 22 | 0.360<br>0.320 | Slight sticking<br>No problem | This invention |
| 116 | 10 | 0.360<br>0.321 | No problem<br>No problem | This invention |
| 117 | 44 | 0.352<br>0.310 | Frequently sticking<br>Occasional occurrence of jam | Comparative example |
| 118 | 46 | 0.390<br>0.380 | Frequently sticking<br>Frequent occurrence of jam | Comparative example |

From the results shown in Table 2, it is understood that even though the addition amount of a releasing agent was increased, good transport property could be attained by addition of a matting agent having a particle diameter of 50% to 200% based on the film thickness of the receptor layer. Further, in this case, it was found that excellent releasing property was obtained by increase in the addition amount of a releasing agent.

Further, both good releasing property and good transport property could be attained in the samples in which the coefficient of static friction between the image-receiving sheet and the ink sheet was 0.28 or more and to which both the releasing agent and the matting agent are added.

With respect to the sample 114 in which the particle diameter of the matting agent exceeds 200% based on the film thickness of the receptor layer, the releasing property was insufficient. The transport property was also insufficient. Therefore, jam occasionally occurred at the time of image output. The jam is a phenomenon that a processing stops on the way owing to incomplete transport. By examining the surface of the sample, it was found that a part of the matting agent was fallen off from the sample. It is assumed that such the defect causes unstable result of the releasing property, and moreover a regular performance of the transport property was not obtained by the defect. The sticking described in the above Table 2 is a phenomenon that a linear non-uniformity (streak) occurs in the image owing to release accident (abnormality).

Example 2

Preparation of Emulsified dispersion A

An emulsified dispersion A was prepared in the following manner. An antioxidant (EB-9) and 12 g of an amino-modified silicone oil, KF-857 (rade names, manufactured by Shin-Etsu Chemical Co., Ltd.), were dissolved in a mixture of 30 g of a high-boiling solvent (Solv-5) and 20 ml of ethyl acetate, and the resulting solution was emulsified and dispersed in 250 g of a 20 mass % aqueous gelatin solution containing 1 g of sodium dodecylbenzenesulfonate by means of a high-speed stirring emulsification machine (dissolver). Thereto, water was added to prepare 380 g of an emulsified dispersion A. Therein, the addition amount of the antioxidant (EB-9) was adjusted so that the compound would be contained in an amount of 30 mol % in the emulsified dispersion A.

(Preparation of Heat-Sensitive Transfer Image-Receiving Sheets 201 to 203)

Heat-sensitive transfer image-receiving sheets 201 to 203 were prepared in the same manner as the heat-sensitive transfer image-receiving sheets 101 to 103, except that the 16% gelatin aqueous solution used for the receptor layer was replaced by 4.2 mass parts of the above-described Emulsion A and the addition amount of water was reduced by 0.7 mass parts in each sheet.

To each of the thus-prepared heat-sensitive transfer image-receiving sheets 201 to 203, there was added the antioxidant (EB-9), the high-boiling solvent and the amino-modified silicone oil as a releasing agent that were emulsified and dispersed.

Similar to Example 1, the releasing property and the transport property were evaluated. In addition, a performance obtained by image formation using the heat-sensitive transfer image-receiving sheet was evaluated.

The thus-obtained results are shown in Table 3 set forth below.

TABLE 3

| Sample No | Releasing property (Peeling force, kgf/cm) | Transport property (Coefficient of static friction) Upper: Untransferred surface Lower: Y solid image surface | Image Upper: Releasing property Lower: Transport property | Remarks |
|---|---|---|---|---|
| 201 | 10 | 0.353 | No problem | This |
| | | 0.311 | No problem | invention |
| 202 | 14 | 0.348 | No problem | This |
| | | 0.312 | No problem | invention |
| 203 | 23 | 0.352 | No problem | This |
| | | 0.318 | No problem | invention |

From the results shown in Table 3, it was found that both good releasing property and good transport property could be attained similarly to the results in Example 1, even though the emulsion was introduced into the receptor layer and silicone oil as a releasing agent was added in the form of the emulsified dispersions.

Example 3

Preparation of Ink Sheet

A polyester film 6.0 μm in thickness (trade name: Lumirror, manufactured by Toray Industries, Inc.) was used as the substrate film. A heat-resistant slip layer (thickness: 1 μm) was formed on the back side of the film, and the following yellow, magenta, and cyan compositions were respectively applied as a monochromatic layer (coating amount: 1 g/m$^2$ after drying) on the front side.

| Yellow composition | |
|---|---|
| Dye (trade name: Macrolex Yellow 6G, manufactured by Byer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

| Magenta composition | |
|---|---|
| Magenta dye (trade name; Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

-continued

| Cyan composition | |
|---|---|
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

An emulsified dispersion A1 was prepared in the following manner. Were mixed 13.5 g of a high-boiling solvent (SOLV-5), 19 g of the following compound EB-9, 9 g of the following compound B-47 and 20 ml of ethyl acetate. The resultant was emulsified and dispersed in 250 g of a 20 mass % aqueous gelatin solution containing 1 g of sodium dodecylbenzenesulfonate by means of a high-speed stirring emulsification machine (dissolver). Thereto, water was added to prepare 380 g of an emulsified dispersion A1.

SOLV-5

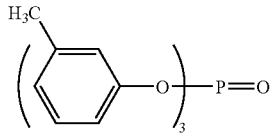

EB-9

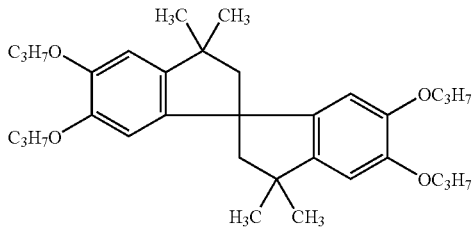

(B-47)

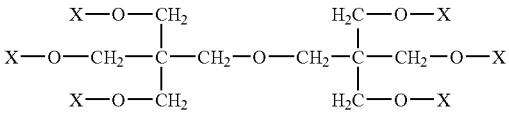

A mixture in which, among 6 X's, 3 X's were —CO(CH$_2$)$_5$OCOCH═CH$_2$, and each of the remaining 3 X's was —OCOCH═CH$_2$ (Preparation of Heat-Sensitive Transfer Image-Receiving Sheet 2101)

A sample was prepared by simultaneous multi-layer coating, so as to form a multiple-layer structure, on the support prepared in the same manner as in Example 1, having a subbing layer, a heat insulation layer, and a receptor layer, in increasing order of distance from the support. Compositions and application amounts of the coating solutions used for the subbing layer and the heat insulation layer each were the same as those in Example 1. A composition and an application amount of the coating solution used for the receptor layer are shown below.

| (Composition) | |
|---|---|
| Vinyl chloride-acrylate latex (VINYBLAN 900 (trade name), produced by Nissin Chemical Industry Co., Ltd.) | 44 parts by mass |
| Vinyl chloride-acrylate latex (VINYBLAN 276 (trade name), produced by Nissin Chemical Industry Co., Ltd.) | 27 parts by mass |
| Emulsified dispersion A1 prepared in the above | 4.2 parts by mass |
| Microcrystalline wax (EMUSTAR-42X (trade name), manufactured by Nippon Seiro Co., Ltd.) | 7 parts by mass |
| Water | 24 parts by mass |
| The compound A described above | 0.05 part by mass |
| NaOH for adjusting pH to 8 | |
| (Coating amount) 18 ml/$m^2$ | |

Immediately before coating, the compound B (cross-linking agent) described above was added to the foregoing receptor layer coating solution. The amount of the compound B added was adjusted to 3 mass % based on the total mass of gelatin in the heat-insulating layer and the receptor layer.

(Preparation of Heat-Sensitive Transfer Image-Receiving Sheets 2102 to 2109 (This Invention))

Heat-sensitive transfer image-receiving sheets 2102 to 2109 were prepared in the same manner as the heat-sensitive transfer image-receiving sheet 2101, except that, the matting agent shown in Table 4 was further added to the receptor layer, respectively. The matting agent was added in an amount of 1.5 mass parts to 100 mass parts of the above-described receptor layer coating solution. Herein, the coating solutions for the receptor layer were prepared by reducing water corresponding to the amount of the added matting agent, so that the total amount would not be changed.

TABLE 4

| Sample No. | Matting agent | Particle diameter (μm) | Tg or Heat decomposition temperature |
|---|---|---|---|
| 2102 | Polystyrene particles | 3.5 | Tg: 100° C. |
| 2103 | Methyl methacrylate particles | 3.5 | Tg: 105° C. |
| 2104 | Crosslinked methyl methacrylate particles | 3.5 | Tg: 135° C. |
| 2105 | Poly(St/DVB = 90/10) particles | 3.5 | Tg: 130° C. |
| 2106 | Poly(St/MAA/DVB = 80/10/10) copolymer particles | 3.5 | Tg: 135° C. |
| 2107 | Melamine-silica resin | 2.0 | Heat decomposition temperature: 300° C. or more |
| 2108 | Melamine-silica resin | 3.5 | Heat decomposition temperature: 300° C. or more |
| 2109 | Melamine-silica resin | 6.5 | Heat decomposition temperature: 300° C. or more |
| 2110 | Poly(St/DVB = 90/10) particles | 6.5 | Tg: 130° C. |

(Image Formation)

The ink sheet and any of the heat-sensitive transfer image-receiving sheets 2101 to 2110 were each worked so as to become loadable, and a printed output was produced on each combination of the ink sheet and any of the image-receiving sheets, in a high-speed print mode under the condition of 35° C. and a humidity of 70%, by use of a sublimation-type thermal transfer printer ASK2000 (trade name, manufactured by FUJIFILM Corporation). The heat-sensitive transfer image-receiving sheets were loaded into the printer after moisture conditioning under the condition of 35° C. and a humidity of 70% for 2 hours. For output images, two kinds of images set forth below were used.

1) High density whole black image (black solid image)
2) Gradation images of from white to the maximum density of various monochromes and gray Each of these two types of images was output successively to obtain 30 sheets of copy, respectively.

Herein, in the high-speed print mode, the time interval between ejection of one printed piece and ejection of the next one was 8 seconds.

(Releasing Property)

Sensory tests of the releasing property were carried out using 2 types of output images in accordance with the following criteria for evaluation.

(Criteria for Evaluation)

A: No problem was seen in all prints.

B: Generation of streaked unevenness (sticking) was slightly seen in some prints (5% of the total number of output sheets).

C: Generation of sticking was seen in a half or more of the total prints.

D: In almost prints, troubles generated owing to incomplete releasing property such as sticking and abnormal transfer (a phenomenon that the whole dye layer of the ink ribbon was transferred).

(Image Graininess)

Using "the gradation images of from white to the maximum density of various monochromes and gray" output in the proceeding test, the following sensory evaluation was carried out upon the region of from white to density of about 1.0. The image graininess is more easily evaluated especially in the low density region. This is a reason why attention is paid to such the low density region. The sensory evaluation was carried out by 5 or more persons. A result announced by a person who evaluated the graininess most severely was used as the evaluation result.

(Criteria for Evaluation)

TABLE 5

| Sample No. | Presence of the matting agent | Releasing property | Image graininess |
|---|---|---|---|
| 2101 (Comparative example) | None | D | A |
| 2102 (This invention) | Presence | B | B |
| 2103 (This invention) | Presence | B | B |
| 2104 (This invention) | Presence | A | B |

TABLE 5-continued

| Sample No. | Presence of the matting agent | Releasing property | Image graininess |
|---|---|---|---|
| 2105 (This invention) | Presence | A | B |
| 2106 (This invention) | Presence | A | B |
| 2107 (This invention) | Presence | A | A |
| 2108 (This invention) | Presence | A | A |
| 2109 (This invention) | Presence | A | A |
| 2110 (This invention) | Presence | A | C |

As is clear from the results shown in Table 5, excellent releasing property were obtained in the samples 2102 to 2110 according to the present invention, as compared to the sample 2101 free of the matting agent.

In particular, each of the samples 2107, 2108 and 2109 containing a melamine resin provided excellent releasing property without deteriorating image graininess, and provided the most excellent multiple performances.

From comparison between the sample 2103 and the sample 2104, it was found that even though both samples used the same type of organic matting agent fine particles, closslinked organic fine particles improved releasing property without deteriorating graininess, as compared to non-closslinked organic fine particles.

From comparison between the sample 2102 and the sample 2105, it was found that even though both samples used the same type of organic matting agent fine particles, organic fine particles containing DVB improved releasing property without deteriorating graininess, as compared to organic fine grains free of DVB.

When the particle diameter was increased from 3.5 μm to 6.5 μm, the poly(St/DVD=90/10) particles impaired graininess within the acceptable region, as was seen from comparison between the sample 2105 and the sample 2110. In contrast, comparison between the sample 2108 and the sample 2109 demonstrated that the melamine-silica resin did not change graininess. From these results, it was found that the melamine-silica resin was especially preferred among organic fine particles.

Example 4

Preparation of Heat-Sensitive Transfer Image-Receiving Sheets 2204, 2205, 2210 and 2208 (This Invention)

Heat-sensitive transfer image-receiving sheets 2204, 2205, 2210 and 2208 were prepared in the same manner as the heat-sensitive transfer image-receiving sheets 2104, 2105, 2110 and 2108, respectively, except that the amount of the matting agent used was reduced. Herein, in the samples 2104, 2105 and 2110, evaluation of graininess was "C" or "B", and in the sample 2108, performance was most excellent in Example 3. Specifically, these samples were prepared in the same manner as the samples of Example 3, except that the amount of the matting agent added to the receptor layer-coating solution was changed from 15 mass parts to 7.5 mass parts. The results obtained by these samples are shown in Table 6 set forth below. In Table 6, these results were described together with a part of the results obtained in Example 3.

TABLE 6

| Sample No. | Presence of the matting agent | Releasing property | Image graininess |
|---|---|---|---|
| 2101 (Comparative example) | None | D | A |
| 2104 (This invention) | Presence | A | B |
| 2105 (This invention) | Presence | A | B |
| 2108 (This invention) | Presence | A | A |
| 2110 (This invention) | Presence | A | C |
| 2204 (This invention) | Presence | B | A |
| 2205 (This invention) | Presence | B | A |
| 2208 (This invention) | Presence | A | A |
| 2210 (This invention) | Presence | B | B |

As is apparent from the results in Table 6, the samples 2204, 2205, 2208 and 2210 of the present invention were excellent in releasing property, compared to the sample 2101 free of the matting agent. Comparing the two samples 2104 and 2204, samples 2105 and 2205, and samples 2110 and 2210 respectively, it is found that reduction in the addition amount of the matting agent slightly deteriorated releasing property within an acceptable region, but improved image graininess. On the other hand, the sample 2208 was excellent in both releasing property and image graininess, as compared to the sample 2108. As a whole, the most excellent results were obtained by sample 2108.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2006-269369 filed in Japan on Sep. 29, 2006, and Patent Application No. 2006-269393 filed in Japan on Sep. 29, 2006, each of which is entirely herein incorporated by reference.

What we claim is:

1. A heat-sensitive transfer image-receiving sheet, comprising, on a support, at least one receptor layer containing a matting agent of organic/inorganic hybrid fine particles, wherein average particle diameter of the matting agent is in the range of from 50% to 200% of the thickness of the receptor layer, and wherein the receptor layer contains a releasing agent.

2. The heat-sensitive transfer image-receiving sheet according to claim 1, wherein said releasing agent is at least one compound selected from the group consisting of wax, a silicone-series compound and a fluorine-series surfactant.

3. The heat-sensitive transfer image-receiving sheet according to claim 1, further comprising at least one heat insulation layer containing at least one kind of hollow polymers.

4. The heat-sensitive transfer image-receiving sheet according to claim 1, wherein said receptor layer contains a latex polymer containing a repeating unit derived from vinyl chloride.

5. The heat-sensitive transfer image-receiving sheet according to claim 1, which is superposed in face to face on a heat-sensitive transfer sheet having at least two-color ink layers successively formed, wherein coefficient of static friction between a surface of the ink layer of the heat-sensitive transfer sheet to be transferred at the first time of image formation and an untransferred surface of the receptor layer of the heat-sensitive transfer image-receiving sheet, is 0.280 or more.

6. The heat-sensitive transfer image-receiving sheet according to claim 5, wherein coefficient of static friction between a surface of the ink layer of the heat-sensitive transfer sheet to be transferred at the second time or later of image formation and the surface of the receptor layer of the heat-sensitive transfer image-receiving sheet, to which the ink has transferred at the maximum density before this ink layer transfers, is 0.280 or more.

7. The heat-sensitive transfer image-receiving sheet according to claim 1, wherein said receptor layer is formed by a method of using an aqueous coating solution.

8. The heat-sensitive transfer image-receiving sheet according to claim 7, further comprising at least one heat insulation layer containing at least one kind of hollow polymers, wherein said receptor layer and said heat insulation layer are formed by a simultaneous multilayer coating.

9. An image-forming method, which comprises superposing a heat-sensitive transfer sheet having at least two-color ink layers successively formed on the heat-sensitive transfer image-receiving sheet according to claim 1, wherein coefficient of static friction between a surface of the ink layer of the heat-sensitive transfer sheet to be transferred at the first time of image formation and an untransferred surface of the receptor layer of the heat-sensitive transfer image-receiving sheet, is 0.280 or more.

10. The image-forming method according to claim 9, wherein coefficient of static friction between a surface of the ink layer of the heat-sensitive transfer sheet to be transferred at the second time or later of image formation and the surface of the receptor layer of the heat-sensitive transfer image-receiving sheet, to which the ink has transferred at the maximum density before this ink layer transfers, is 0.280 or more.

11. The image-forming method according to claim 9, wherein the matting agent is a matting agent of melamine-silica resin fine particles.

12. The image-forming method according to claim 9, wherein the receptor layer comprises a latex polymer and a water-soluble polymer.

13. The image-forming method according to claim 9, wherein the receptor layer comprises a latex polymer of a copolymer containing a repeating unit derived from vinyl chloride and an α,β-unsaturated carboxylate, and a water-soluble polymer.

14. The image-forming method according to claim 9, wherein a heat insulation layer is formed between the receptor layer and the support, and wherein the heat insulation layer contains a gelatin.

15. The image-forming method according to claim 9, wherein the average particle diameter of the matting agent is 1 to 10 μm.

16. A method of producing the heat-sensitive transfer image-receiving sheet according to claim 1, which comprises forming the receptor layer by a method of using an aqueous coating solution.

17. The method according to claim 16, wherein the heat-sensitive transfer image-receiving sheet further comprises at least one heat insulation layer containing at least one kind of hollow polymers, and wherein the method comprises forming said receptor layer and said heat insulation layer by a simultaneous multilayer coating.

18. The heat-sensitive transfer image-receiving sheet according to claim 1, wherein the matting agent is a matting agent of melamine-silica resin fine particles.

19. The heat-sensitive transfer image-receiving sheet according to claim 1, wherein the receptor layer comprises a latex polymer and a water-soluble polymer.

20. The heat-sensitive transfer image-receiving sheet according to claim 1, wherein the receptor layer comprises a latex polymer of a copolymer containing a repeating unit derived from vinyl chloride and an a,(3-unsaturated carboxylate, and a water-soluble polymer.

21. The heat-sensitive transfer image-receiving sheet according to claim 1, wherein a heat insulation layer is formed between the receptor layer and the support, and wherein the heat insulation layer contains a gelatin.

22. The heat-sensitive transfer image-receiving sheet according to claim 1, wherein the water-soluble polymer in the heat insulation layer is a gelatin.

23. The heat-sensitive transfer image-receiving sheet according to claim 1, wherein the average particle diameter of the matting agent is 1 to 10 μm.

24. A heat-sensitive transfer image-receiving sheet comprising, on a support, at least one receptor layer containing a matting agent, and at least one heat insulation layer containing a latex polymer of hollow polymer particles, and a water-soluble polymer;

wherein said matting agent is fine particles having a particle diameter of from 1 to 10 μm and containing an organic compound;

wherein the receptor layer comprises at least one kind of latex polymer of a copolymer containing a repeating unit derived from vinyl chloride and an α,β-unsaturated carboxylate, and a water-soluble polymer;

wherein the heat insulation layer is formed between the support and the receptor layer;

wherein the particle size of the hollow polymer particles is 0.1 to 2 um; and wherein the hollow polymer particles are non-foaming type hollow particles and formed of a polystyrene resin, an acryl resin or a styrene-acryl resin.

25. The heat-sensitive transfer image-receiving sheet according to claim 24; wherein a glass transition temperature of the matting agent is 90° C. or more.

26. The heat-sensitive transfer image-receiving sheet according to claim 24, wherein a glass transition temperature of the matting agent is 130° C. or more.

27. The heat-sensitive transfer image-receiving sheet according to claim 24, wherein a decomposition temperature of the matting agent is 200° C. or more.

28. The heat-sensitive transfer image-receiving sheet according to claim 24, wherein the matting agent comprises a melamine resin.

29. A method of producing the heat-sensitive transfer image-receiving sheet according to claim 24, which comprises coating the receptor layer and a layer adjacent to the receptor layer by a simultaneous multilayer coating.

30. The method according to claim 29, wherein said adjacent layer is a heat insulation layer.

31. The heat-sensitive transfer image-receiving sheet according to claim 24, wherein the matting agent is a matting agent of organic/inorganic hybrid fine particles.

32. The heat-sensitive transfer image-receiving sheet according to claim 24, wherein the matting agent is a matting agent of organic/inorganic hybrid fine particles of melamine-silica resin.

* * * * *